US012290123B2

(12) United States Patent
Turner et al.

(10) Patent No.: US 12,290,123 B2
(45) Date of Patent: May 6, 2025

(54) PROTECTIVE HELMET WITH DISPLAY

(71) Applicant: Seamless Digital Limited, Towcester Northamptonshire (GB)

(72) Inventors: Robert Turner, Towcester Northamptonshire (GB); Mark Turner, Towcester Northamptonshire (GB)

(73) Assignee: Seamless Digital Limited, Towcester (GB)

( * ) Notice: Subject to any disclaimer, the term of this patent is extended or adjusted under 35 U.S.C. 154(b) by 104 days.

(21) Appl. No.: 18/277,613

(22) PCT Filed: Feb. 14, 2022

(86) PCT No.: PCT/GB2022/050389

§ 371 (c)(1),
(2) Date: Aug. 17, 2023

(87) PCT Pub. No.: WO2022/175644

PCT Pub. Date: Aug. 25, 2022

(65) Prior Publication Data

US 2024/0130456 A1 Apr. 25, 2024
US 2024/0225165 A9 Jul. 11, 2024

(30) Foreign Application Priority Data

Feb. 17, 2021 (GB) ..... 2102236
Sep. 9, 2021 (GB) ..... 2112833

(51) Int. Cl.
*A42B 3/04* (2006.01)
*A42B 3/24* (2006.01)

(52) U.S. Cl.
CPC ..... *A42B 3/042* (2013.01); *A42B 3/046* (2013.01); *A42B 3/0466* (2013.01); *A42B 3/24* (2013.01)

(58) Field of Classification Search
CPC ..... A42B 3/042; A42B 3/046; A42B 3/0466; A42B 3/24
See application file for complete search history.

(56) References Cited

U.S. PATENT DOCUMENTS 8,562,166 B1 * 10/2013 Kutnyak ..... A42B 3/044 40/329
10,716,352 B2 * 7/2020 Knight ..... A42B 3/063
(Continued)

FOREIGN PATENT DOCUMENTS

CN 103610262 B 3/2016
EP 2589511 A1 5/2013
GB 2583021 A 10/2020

OTHER PUBLICATIONS

International Search Report and Written Opinion in PCT International Application No. PCT/GB2022/050389 mailed Apr. 28, 2022.
(Continued)

*Primary Examiner* — Christopher E Dunay
(74) *Attorney, Agent, or Firm* — Cognition IP, P.C.; Edward Steakley

(57) ABSTRACT

A protective helmet (200) adapted for the external display of controllably selectable images, comprising: an outer portion (202); and a display module (212) comprising a flexible electronic display screen (214); wherein the outer portion comprises a recess (206) configured to receive the display module; and wherein the display module is positioned within the recess such that an outer surface (213) of the display module continues a profile of the outer portion.

28 Claims, 27 Drawing Sheets

(56) References Cited

U.S. PATENT DOCUMENTS

| | | | | |
|---|---|---|---|---|
| 11,717,045 | B2 * | 8/2023 | Lombard | A42B 3/044 362/106 |
| 2010/0313334 | A1 | 12/2010 | Moy | |
| 2013/0167290 | A1 | 7/2013 | Ben | |
| 2014/0250571 | A1 | 9/2014 | Pippillion et al. | |
| 2015/0109129 | A1 | 4/2015 | Merril et al. | |
| 2018/0201181 | A1 | 7/2018 | Cook | |
| 2019/0261724 | A1 | 8/2019 | Chen et al. | |
| 2023/0000197 | A1 * | 1/2023 | Snowton | G09F 9/33 |
| 2024/0130458 | A1 * | 4/2024 | Malmegård | A42B 3/0466 |
| 2024/0180283 | A1 * | 6/2024 | Righi | A42B 3/226 |

OTHER PUBLICATIONS

Patents Act 1977: Search Report under Section 17 received in GB application No. GB2102236.3, mailed on Apr. 14, 2021.
Patents Act 1977: Combined Search and Examination Report under Sections 17 & 18(3) received in GB application No. GB2112833.5, mailed on Mar. 9, 2022.

* cited by examiner

PROTECTIVE HELMET WITH DISPLAY

CROSS-REFERENCE TO RELATED APPLICATIONS

This application is a 35 U.S.C. § 371 national stage application of PCT International Application No. PCT/GB2022/050389, filed on Feb. 14, 2022, which claims the benefit of Great Britain Application No. 2102236.3, filed Feb. 17, 2021, and Great Britain Application No. 2112833.5, filed Sep. 9, 2021. The contents of the above patent applications are hereby incorporated by reference in their entirety.

FIELD OF INVENTION

The present invention relates to electronic displays for protective helmets, particularly crash helmets suitable for use in motorsport, and to attachments therefor.

BACKGROUND

The current form of the modern racing crash helmet consists of a hard outer moulded shell, made from carbon fibre composite or glass fibre composite, with several cutouts in the shell for ventilation and for the visor aperture. The interior of the shell is formed with shock absorbing materials, and sculpted to conform to the user's head. These two pieces form the primary safety features of the helmet, between them, constituting the strength and shock absorbing functions of the helmet.

Known motor racing crash helmets often also include a hinged transparent visor that moves to cover the viewing aperture. Separate aerodynamic moulded sections that cover ventilation holes can also be provided, which may also be moveable. Moulded sections may be applied to the outside, which serve an aerodynamic function only. These features are often removable and do not serve any safety function, and are generally affixed using double sided foam tape or plastic clips. Attachable items such as visors, aerodynamic moulded sections and ventilation moulded sections are referred to herein as helmet attachments.

Most helmets used for racing, incorporate a communication device built into the helmet, and connected to the racing vehicle using a flexible cable. In some cases, the helmets contain a wireless communication system, in which cases, the helmet would contain a power source for running the system.

In helmets including a transparent or partially transparent visor (such as those typically used in motorsport racing), it is known to provide means to reduce the condensation on the inside surface of the visor. Commonly this condensation or "fogging up" is alleviated with ventilation. Alternatively, it is known provide a secondary "anti-fog" layer on the inside of the visor, separated from the inside surface of the main visor by a small air gap, and sealed around a perimeter of the anti-fog layer using adhesive or foam tape.

In recent years, developments in motor sport media coverage have allowed crash helmets to be shown in detail, for example during televised motorsport coverage. In particular during automobile and motorcycle racing, it is common to provide a camera pointing back towards the driver/rider's face. In other instances, there may be a camera mounted behind and above the driver's helmet that shows a view of the rear of the helmet along with the track ahead. In other instances, there will be media appearances where the helmet is visible, either being worn, or held in view. In all these cases, where the helmet is in view there are opportunities to display advertising. The current state of the art allows for static advertising only, that is a single tranche of advertising, that can be determined before the event, but not changed during the event.

The exterior cosmetic design for known crash helmets typically consists of a painted finish and or stickers applied to the outside. When a change in the cosmetic appearance of the helmet is required, the helmet must be repainted and/or have different stickers applied.

Similar considerations also apply to protective helmets used in other sports.

Accordingly, there is a desire to improve the speed with which the external appearance of a protective helmet can be changed.

SUMMARY OF INVENTION

In order to mitigate at least some of the issues above, a first aspect of the invention provides a protective helmet adapted for the external display of controllably selectable images, comprising: an outer portion (for example an outer shell of the helmet, or the outer surface of a helmet attachment such as a visor, a ventilation attachment, an aerodynamic attachment); and a display module comprising a flexible electronic display screen; wherein the outer portion comprises a recess configured to receive the display module; and wherein the display module is positioned within the recess such that an outer surface of the display module continues a profile of an outer surface of the outer portion.

Advantageously, this arrangement allows for the external appearance of the crash helmet to be dynamically altered without the need to repaint or reapply permanent graphics. Further, this configuration allows for minimal change to the outside contours/profile of the helmet, thus reducing/avoiding any disruption to the aerodynamic properties of the helmet.

Preferably the flexible electronic display screen is a reflective display screen such as e-paper, advantageously allowing the displayed content to behave in the same manner as traditional static graphics under the varied illumination conditions of a typical sports event. The reflective display screen may have a display area having any suitable shape, and have a perimeter comprising straight or curved edges, or combinations thereof. For Instance, the flexible electronic display screen may be shaped so as to conform to a shape of the helmet.

Optionally the helmet includes a visor configured to move between an open position and a closed position; wherein the visor covers the outer surface of the display module when in the closed position, such that content displayed on the flexible electronic display screen is visible through the visor. Advantageously this allows the visor to protect the display module, whilst facilitating easy access to the display module by opening/removing the visor.

Optionally the display module further comprises an at least partially optically clear layer (e.g., an optically clear layer of plastics material) covering an outer surface of the flexible electronic display screen wherein an outer surface of the at least partially optically clear layer continues the profile of the outer surface of the outer portion. Preferably the outer surface of the at least partially optically clear layer is curved in a first plane and in a second plane orthogonal to the first plane (i.e., it has compound curves)—in this case is preferred that the recess is curved in a single plane only. Advantageously this allows for a compound curve outer profile while avoiding potentially damaging being of the flexible electronic display screen.

Optionally the at least partially optically clear layer is formed by applying a clear polymerizable material to the helmet, hardening the at least partially optically clear layer to produce a polymerized material, and shaping (e.g., by sanding) the hardened polymerized material. Advantageously this not only provides a convenient means for producing compound curves, but further assists in securing components of the display module and enabling a substantially seamless transition between the outer shell of the helmet and the outer surface of the display module.

Optionally the at least partially optically clear layer includes one or more voids, for example voids in portions of the at least partially optically clear layer through which the flexible display is not visible, thereby advantageously reducing weight.

Optionally, the recess comprises a floor and a step, the step extending along a peripheral edge of the floor, and the step having a shallower depth than the floor with respect to the outer surface of the outer portion; the at least partially optically clear layer extends beyond a periphery of the flexible electronic display screen; and the at least partially optically clear layer is affixed to the step.

Optionally, the outer portion comprises a portion adjacent to the recess, the recess comprises a floor and a wall extending between the floor and the portion adjacent to the recess, and the wall lies at an obtuse angle with respect to each of the floor and the portion adjacent to the recess. This reduces the number of stress raising points during manufacture, meaning less material and hence weight is needed to achieve a particular strength.

Preferably the protective helmet comprises a display controller communicably coupled to the display module; or the display module comprises a display controller; or the display module comprises a wired or wireless connection to a display controller.

Optionally the helmet also includes a proximity sensor: wherein the proximity sensor is configured to detect when the protective helmet is being worn, and to provide a signal indicative that the protective helmet is being worn to the display controller; and wherein the display controller is configured to activate the flexible electronic display responsive to receiving the signal from the proximity sensor. Beneficially this provides a convenient means for initiating or otherwise triggering the display of content/triggering a change in the display of content on the flexible electronic display screen.

Preferably the helmet further comprises an environmental sensor, configured to detect a physical state of the protective helmet and to provide a signal indicative of the physical state of the helmet to the display controller; wherein the display controller is configured to control the flexible electronic display responsive to receiving the signal from the environmental sensor. Optionally the environmental sensor is a shock sensor; the display controller is connected to a biometric sensor configured to measure biometric information of the wearer of the protective helmet; and the display controller is configured to cause the flexible electronic display screen to display biometric information (for example blood oxygen saturation level, heart rate, breathing rate, etc.) in response to the shock sensor detecting a shock greater than a predetermined amount. Advantageously this allows for the effective display of biometric information in a location that is easily visible to medical personnel in the event of an accident or impact.

A second aspect of the invention provides a protective helmet attachment (for example a visor, a ventilation attachment, or an aerodynamic attachment) adapted for the external display of controllably selectable images, comprising: an outer surface; and a display module comprising a flexible electronic display screen (for example a reflective display screen such as e-paper); wherein the display module is shaped and positioned so as to conform a profile of the outer surface. For example, an exterior surface of the display module may be shaped so as to continue the profile of the outer surface, or alternatively shaped to be positioned against (for example behind) an optically clear panel that continues the profile of the outer surface.

The flexible electronic display screen may have a display area having any suitable shape, and have a perimeter comprising straight or curved edges, or combinations thereof. For instance, the flexible electronic display screen may be shaped so as to conform to a shape of the protective helmet attachment.

Optionally the protective helmet attachment further comprises an optically clear portion, wherein: the display module is positioned beneath the optically clear portion such that the flexible electronic display is visible through the optically clear portion; and the optically clear portion continues the profile of the outer surface. For example, where the attachment is a ventilation or aerodynamic attachment, the optically clear portion may be an optically clear panel, for example made from plastics material, optionally fabricated separately from the rest of the attachment. Alternatively, where the attachment is a visor, the optically clear portion may be part of the visor itself, such that the display module is positioned against an inside surface of the visor.

Optionally the protective helmet attachment further comprises a recess configured to receive the display module, wherein the display module is positioned within the recess such that the display module continues the profile of the outer surface.

Optionally, the protective helmet attachment is a visor comprising an anti-fog layer wherein the display module is positioned between an inner surface of the visor and the anti-fog layer.

Optionally, the protective helmet attachment is a visor comprising a recess; the display module is positioned in the recess.

Optionally, the display module comprises an at least partially optically clear housing, the at least partially optically clear housing comprises the optically clear portion, and the at least partially optically clear housing comprises the recess such that the flexible electronic display screen is visible through the optically clear portion of the at least partially optically clear housing. The at least partially optically clear housing optionally has an outer surface with a compound curvature, preferably wherein the recess has a curvature in a single plane.

Optionally the optically clear portion comprises a panel of optically clear plastics material; the display module and optically clear panel are positioned within the recess such that the optically clear panel continues a profile of the outer surface. Optionally the recess comprises a floor and a step, the step extending around a periphery of the floor, and the step having a shallower depth than the floor with respect to the outer surface; the panel of optically clear plastics material extends beyond a periphery of the flexible electronic display screen; and the panel of optically clear plastics material is affixed to the step.

Preferably the attachment comprises a display controller communicably coupled to the display module; the display module comprises a display controller; or the display module comprises a wired or wireless connection to a display controller.

Optionally the attachment comprises an environmental sensor, configured to detect a physical state of the protective helmet and to provide a signal indicative of the physical state of the helmet to the display controller; wherein the display controller is configured to control the flexible electronic display responsive to receiving the signal from the environmental sensor. Optionally the environmental sensor is a shock sensor; the display controller is connected to a biometric sensor configured to measure biometric information of the wearer of the protective helmet; and the display controller is configured to cause the flexible electronic display screen to display biometric information in response to the shock sensor detecting a shock greater than a predetermined amount.

In one embodiment a protective helmet comprising the protective helmet attachment above is provided. The protective helmet optionally comprises a proximity sensor: wherein the proximity sensor is configured to detect when the protective helmet is being worn, and to provide a signal indicative that the protective helmet is being worn to the display controller; and wherein the display controller is configured to activate the flexible electronic display responsive to receiving the signal from the proximity sensor. In addition/alternatively the protective helmet optionally further comprises an environmental sensor, configured to detect a physical state of the protective helmet and to provide a signal indicative of the physical state of the helmet to the display controller; wherein the display controller is configured to control the flexible electronic display responsive to receiving the signal from the environmental sensor. Optionally the environmental sensor is a shock sensor; the display controller is connected to a biometric sensor configured to measure biometric information of the wearer of the protective helmet; and the display controller is configured to cause the flexible electronic display screen to display biometric information in response to the shock sensor detecting a shock greater than a predetermined amount.

BRIEF DESCRIPTION OF THE DRAWINGS

Embodiments of the present invention will now be described, by way of example only, with reference to the following figures in which.

DETAILED DESCRIPTION

The following description describes embodiments of the invention as applied to crash helmets (e.g., crash helmets used by drivers and pit crews in motorsports, such as Formula 1, Formula E, Moto GP, IndyCar, etc.), however the skilled person would readily appreciate that the invention can be applied to protective helmets in general (for example protective helmets for contact sports, or high speed water sports). In addition, the flexible display screens described in the embodiments below have a generally rectangular display area—it will be appreciated that the display area can be of any suitable shape, and include a perimeter having straight and or curved portion (e.g., display areas being regular, irregular and/or curvilinear polygons, ellipses, or other shapes).

Figure 1A:
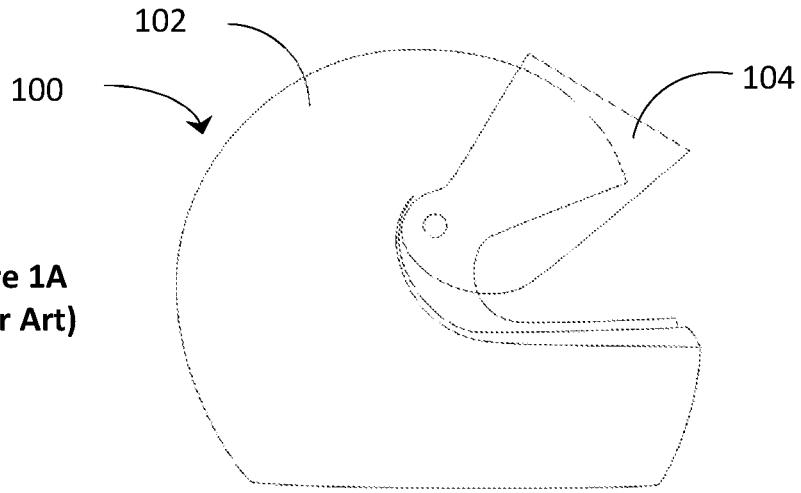
Figure 1A (Prior Art)
FIGS. 1A and 1B show side views of a crash helmet as known in the art.
Figure 1B:
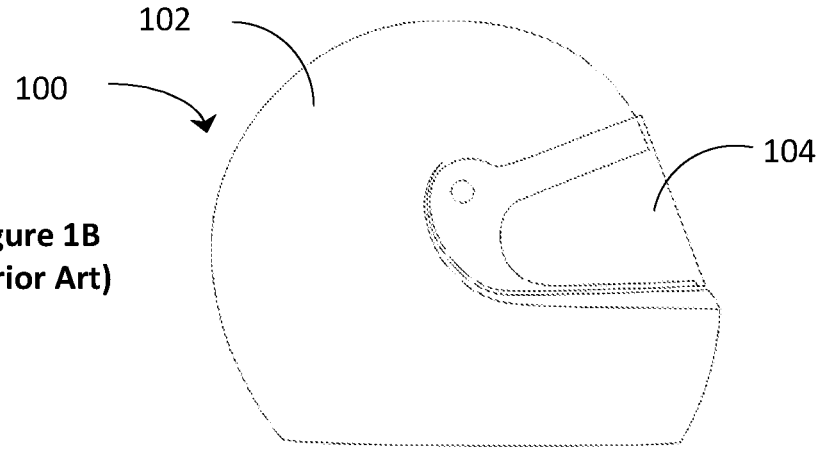
Figure 1B (Prior Art)
Figure 1C:
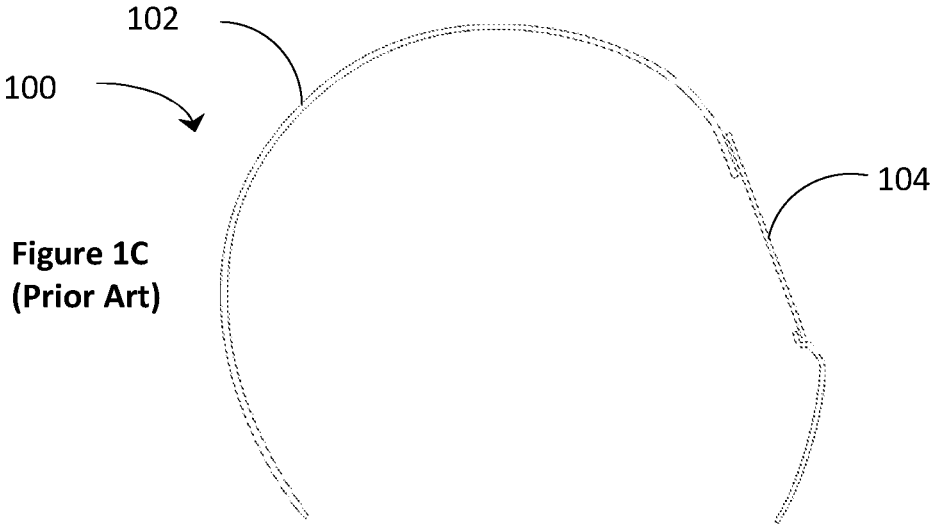
Figure 1C (Prior Art)
FIG. 1C shows a cross section of selected components of the known crash helmet of FIGS. 1A and 1B.

FIGS. 1A and 1B show side views of a known type of crash helmet 100. FIG. 1C shows a cross section of some of the components of the crash helmet 100. The crash helmet 100 includes an outer shell 102, for example an outer shell of protective material such as fibreglass, carbon fibre, Kevlar or polycarbonate. The crash helmet 100 also includes an interior shock absorbing padding material such as expanded polystyrene (not shown), shaped so as to conform to a wearer's head, and configured to provide cushioning in the event of impact. The crash helmet also includes a visor 104, typically made from an at least partially optically clear plastics material. The visor 104 may be movable between open (see FIG. 1A) and closed (see FIG. 1B) positions.

In a first embodiment, a protective helmet is provided having a display module housed in a recess in the outer shell of the helmet. The display module may be positioned underneath a visor (as shown in FIGS. 8A to 10C) or elsewhere in the exterior of the helmet (as shown in FIGS. 2A-2D).

Figure 2A:
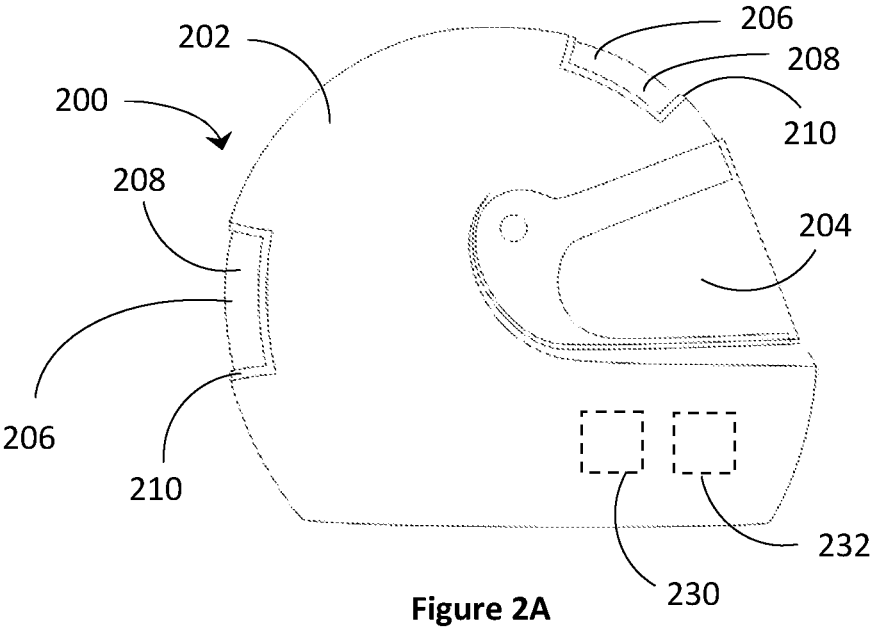
FIG. 2A shows a side view of a protective helmet including recesses for accommodating a display module in accordance with an embodiment of the present invention.
Figure 2B:
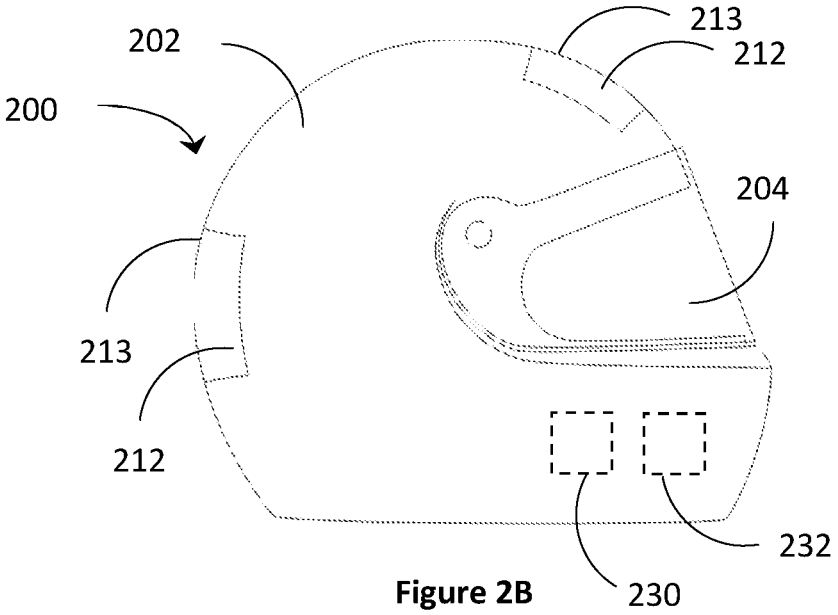
FIG. 2B shows a side view of the helmet of FIG. 2A with display modules installed, in accordance with an embodiment of the present invention.
Figure 2C:
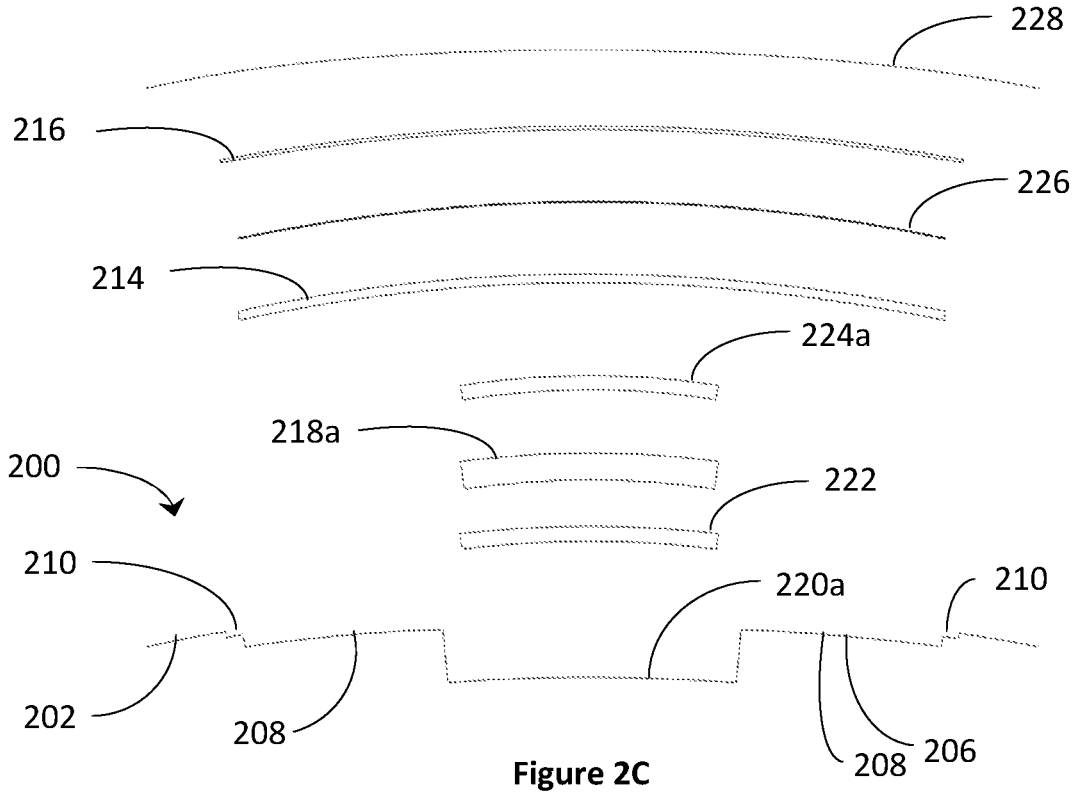
FIGS. 2C and 2D show schematic exploded cross sections of a portion of the crash helmet of FIGS. 2A and 2B in accordance with two respective alternatives of an embodiment of the present invention.
Figure 2D:
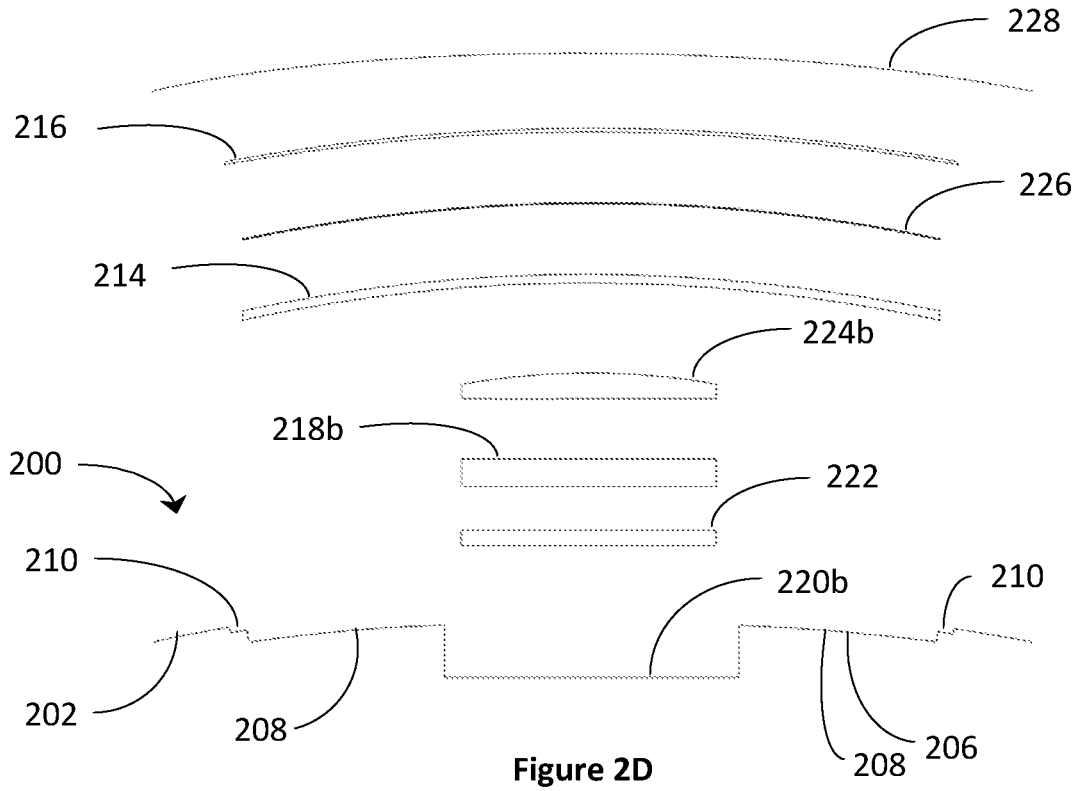

FIGS. 2A and 2B show side views of a protective helmet 200 in accordance with an embodiment of the invention, before and after installation of a display module 212 respectively. FIGS. 2C and 2D show schematic exploded cross sections of a portion of the crash helmet 200 according to two different alternative arrangements. The crash helmet 200 includes an outer shell 202, for example an outer shell of protective material (such as fibreglass, carbon fibre, Kevlar or polycarbonate) as known in the art. The helmet 200 preferably includes a visor 204 as known in the art. The visor 204 may optionally include an anti-fog layer as known in the art (not shown). The helmet 200 also includes interior shock absorbing material (such as expanded polystyrene) as known in the art (not shown for clarity).

The outer shell 202 includes a recess 206 having a floor 208. Preferably the profile of the floor 208 matches the profile of the outer shell 202 proximate to the recess 206. For example the floor 208 may have a curvature that is the same or similar to that of the outer shell 202 proximate to the recess 206. Advantageously, this reduces the amount of space within the helmet that is taken up by the recess 206.

The helmet includes a display module 212, including a flexible electronic display screen 214, which is positioned within the recess 206. The flexible display may be of any suitable shape, for example rectangular (when flat) or other shape. The display module 212 is positioned within the recess 206 such that an outer surface 213 of the display module continues a profile of an outer surface 213 of the outer shell 202, providing a continuous surface profile to the crash helmet 200. For example, the outer surface 213 of the display module may conform to the profile that the outer shell 202 would have had were there no recess 206 present. Advantageously, use of a flexible electronic display screen 214 in a display module 212 in such a way allows the use of a display with little or no impact of the aerodynamic properties of the helmet.

Preferably the flexible electronic display is a reflective display (i.e., a display that reflects ambient light to display content, rather than emitting light), such as an e-paper display. Advantageously, use of a reflective display means that displayed content does not need to be adjusted for changing ambient conditions (e.g., ambient illumination colour, brightness, etc.), such as typically occur in motorsport environments. By using a reflective display, the displayed content looks natural when illuminated by lighting that is typical for painted/printed graphics and stickers in a motorsport environment. Thus, the displayed content advantageously mimics the appearance of graphics applied to helmets using traditional methods (e.g., paint, stickers).

Optionally, the recess 206 includes a step 210 that extends along one or more peripheral edges of the recess 206. The depth of the step is shallower with respect to the outer shell 202 proximate to the recess 206 than the depth of the floor 208 with respect to the outer shell 202 proximate to the recess 206. In this example, the display module 212 includes a protective, at least partially optically clear layer 216, preferably an optically clear plastics layer, which covers the flexible electronic display 214, extending beyond at least one edge of the flexible electronic display 214. The edge of the protective optically clear plastics layer 216 is preferably affixed directly to the step 210 (the step having a depth relative to the outer shell 202 proximate to the recess 206 substantially the same as the thickness of the protective optically clear plastics layer 216). This arrangement provides a convenient means for both protecting and securing the flexible electronic display 214 as well as ensuring that the outer surface 213 of the display module continues a profile of the outer surface 213 of the outer shell 202.

In the preferred embodiment a display controller 218*a*, 218*b* is also provided. The display controller 218*a*, 218*b* is configured to control the flexible electronic display 214, causing the flexible electronic display to selectively display content. The display controller 218*a*, 218*b* may be provided in the helmet 200 at a position remote from the display module 212, and communicate with the flexible electronic display means via a wired or wireless connection. Alternatively, the display controller may be provided external to the helmet (for example in other protective clothing, or in a vehicle associated with the wearer of the helmet), in which case the helmet includes wired or wireless communication means (not shown) to enable the display controller 218*a*, 218*b* to communicate with the flexible electronic display 214. In a more preferred alternative, the display module 212 comprises a display controller 218*a*, 218*b*, as shown in FIGS. 2C and 2D. In embodiments where the display module 212 comprises the display controller 218*a*, 218*b*, a further recess 220*a*, 220*b* is optionally provided within the recess 206 to house the display controller 218*a* 218*b*. Preferably the display controller 218*a* is fabricated on a flexible PCB, in which case the further recess 220*a* may be have a profile matching that of the recess 206 and/or the outer shell 202 proximate to the recess 206 (as shown in FIG. 2C). In embodiments where no step 210 is provided, the display module 212 is preferably held in place by an adhesive placed between the recess 206 and the display module 212 (for example between the foam layer 222 and the recess 216). Alternatively, the display controller 218*b* may be fabricated on a standard (non-flexible) PCB, in which case the profile of the further recess 220*b* Is flat, and a shaped support member, such as a shaped adhesive foam member 224*b*, is provided between the display controller 218*b* and the flexible electronic display screen 214 (as shown in FIG. 2D).

In one example, the display controller 218*a*, 218*b* is optionally attached to the further recess 220*a*, 220*b* via a foam layer 222. Preferably foam layer 222 includes an adhesive on the side facing the display controller 218*a*, 218*b*. The flexible electronic display screen 214 is then attached to the display controller 218*a*, 218*b* by means of a double-sided adhesive foam layer 224*a*, 224*b*. The protective optically clear plastics layer 216 may then be attached to the flexible electronic display screen 214 by means of an optically clear adhesive 226, such as an adhesive film (e.g., a double-sided adhesive film or tape), and secured to the step 210 as described above to retain the complete display module 212 within the recess 206. Alternatively, the display module 212 may be pre-assembled on an installation frame/jig that is either flexible, or has a profile matching that of the outer shell 202 proximate the recess 206, then brought into engagement with the recess 206 containing a suitable adhesive (such as a UV curable adhesive), then the installation frame/jig can be removed, leaving the assembled helmet 200.

In the event that any gap is present between the outer surface of the display module 212 at the outer shell 202 after installation, the gap is preferably filled with a smoothable filling medium.

Once the display module 212 has been installed, optionally a layer of at least partially clear vinyl wrap material 228 is applied over the display module, extending over at least a portion of the outer shell 202. This further ensures that the surface profile of the helmet 200 is continuous and without interruptions, thereby retaining good aerodynamic properties. Optionally, the vinyl wrap material 228 may have a printed (for example pre-printed) pattern over a part of its surface, for example a "fade-in" pattern, positioned around a marginal area of the display module 212 and designed to disguise the edge of the display module 212.

In the preferred embodiment, the helmet 200 includes a proximity sensor 230 configured to detect when the helmet 200 is being worn. The proximity sensor 230 may be any suitable proximity sensor known in the art. When the proximity sensor 230 detects the presence of wearer's head within the helmet 200 (i.e., it detects that the helmet 200 is being worn), the proximity sensor 230 provides a signal indicative that the helmet 200 is being worn to the display controller 218*a*, 218*b*. In response to the signal, the display controller 218*a*, 218*b* operates the flexible electronic display screen 214, for example activating/initiating the flexible electronic display screen 214 or changing the content displayed on the flexible electronic display screen 214.

In the preferred embodiment, the helmet 200 also includes an environmental sensor 232. The environmental sensor 232 is configured to detect a physical state of the helmet 200. For example, the environmental sensor 232 may be an inertial shock sensor configured to detect force experienced by the helmet. The environmental sensor 232 is configured to send a signal to the display controller 218*a*, 218*b* indicative of the physical state of the helmet 200, and the display controller 218*a*, 218*b* is configured to control the flexible electronic display 214 responsive to receiving the signal. For example, the signal can be used as a trigger to change what is displayed on the flexible electronic display screen 214.

Use of a shock sensor in particular may be advantageous in the event of the wearer of the helmet being involved in an impact. On detecting the force of the impact (for example by detecting a force on the helmet over a threshold amount, for a certain time period), the shock sensor sends a signal to the display controller 218*a*, 218*b*. This triggers the display controller 218*a*, 218*b* to cause the flexible electronic display screen 214 to display information useful to emergency service personnel. Such information may include the force experienced by the helmet (e.g., shock loading that occurred during an impact), and/or biometric information (e.g., heart rate, blood oxygen, temperature, historical data regarding any pre-existing medical conditions) received from suitable biometric sensors in communication with the display controller 218*a*, 218*b*. Such biometric sensors may be included in the helmet 200 itself (not shown), or in other wearable items worn by the wearer of the helmet 200, and may communicate with the display controller by any suitable wired or wireless means. Advantageously the clear display of this information, on the wearer itself, may help to quickly and effectively inform emergency service personnel whether and what assistance the wearer requires.

As an alternative or in addition to the use of sensors 230, 232 as described above, in one example, instructions for displaying an image/images are generated by an application running on an external computing device (for example a mobile computing device) and transmitted to the display controller 218*a*, 218*b* via a wireless communication module communicatively coupled to the display controller 218*a*, 218*b*. The display controller 218*a*, 218*b* then controls the electronic display screen 214 based on the received instructions. Beneficially, by moving the processing tasks required for generating instructions for the control means to an external device, less computing and power resource is required at the display controller 218*a*, 218*b*. Accordingly, where the display controller 218*a*, 218*b* Is provided as part of the display module 212, the size and power consumption of the display module 212 can be reduced. Additionally, the application running on the external device can be configured to allow a user to effectively change and otherwise control the images displayed on the electronic display screen 214—the application preferably generates or modifies the instructions in response to user input to the application at the external device.

Figure 3A:
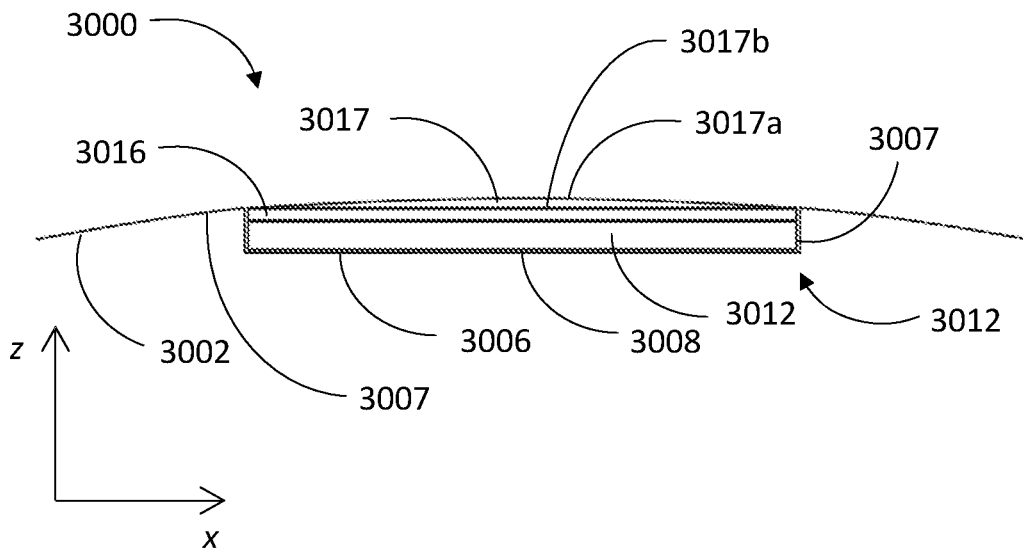
FIG. 3A shows a schematic cross section of portion of a crash helmet along a first axis according to an embodiment of the invention.
Figure 3B:
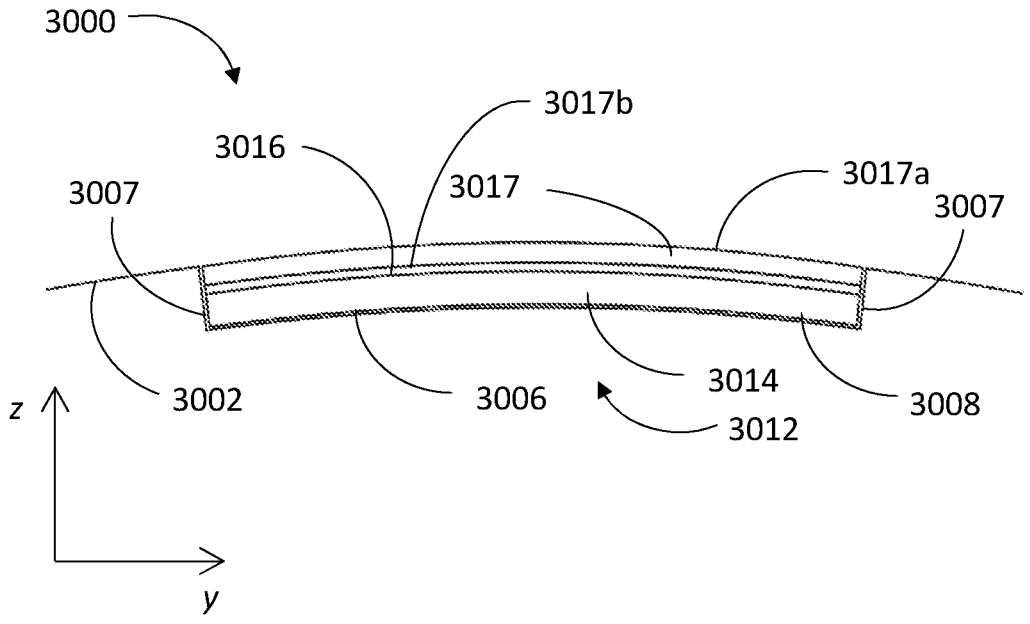
FIG. 3B shows a schematic cross section of a portion of the crash helmet of FIG. 3A along a second axis perpendicular to the first axis.

FIGS. 3A to 3E illustrate an alternative/additional arrangement to that shown in FIGS. 2A-2D. FIG. 3A shows a schematic cross section of portion of a crash helmet 3000 along a first axis, i.e., in a first plane xz. FIG. 3B shows a cross section of the same crash helmet 3000 along a second axis perpendicular to the first axis, i.e., in a second plane yz orthogonal to the first plane xz. As with the embodiment of FIGS. 2A-2C, crash helmet 3000 includes an outer shell 3002 having a recess 3006 formed therein for receiving a display module 3012. The display module 3012 includes a flexible display screen 3014 (e.g., a reflective display screen), of any suitable shape (e.g., substantially rectangular as shown or another shape). In this embodiment, recess 3002 has a floor 3008 and walls 3007. A display controller is preferably provided either as part of the display module 3012 (such as the display controllers 218*a*, 218*b* as described above in relation to the embodiment of FIGS. 2A-2D, or remote from the display module. Similarly, sensors (not shown) can also be provided, as described in relation to the proximity 230 and environmental sensors 232 of the embodiment of FIGS. 2A-2D.

Figure 3C:
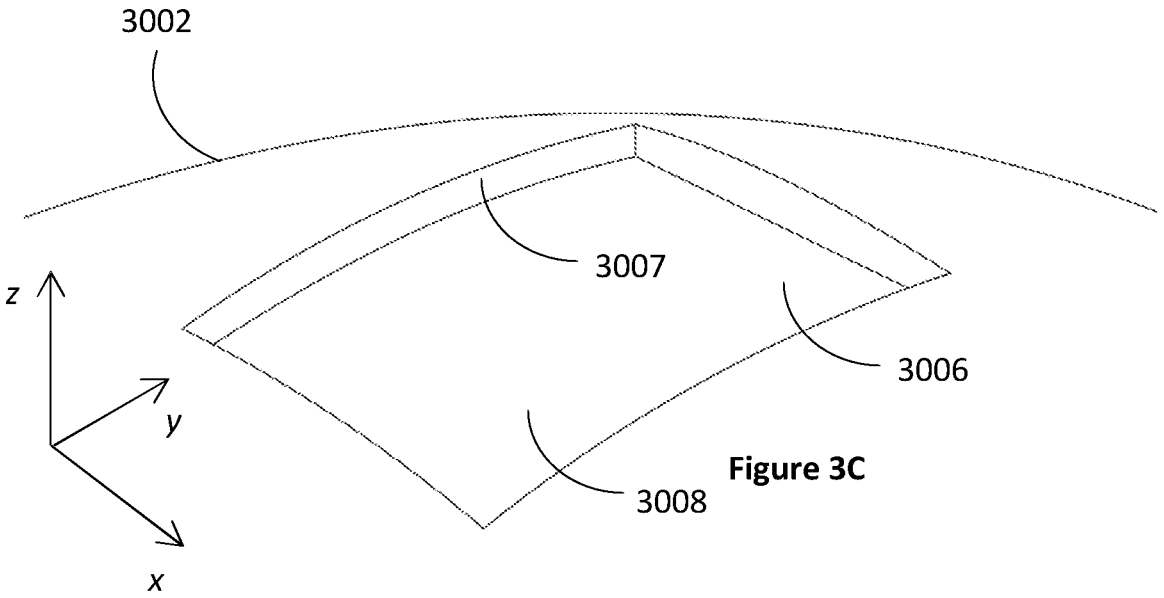
FIGS. 3C to 3E show perspective views of components of the crash helmet of FIGS. 3A and 3B.
Figure 3D:
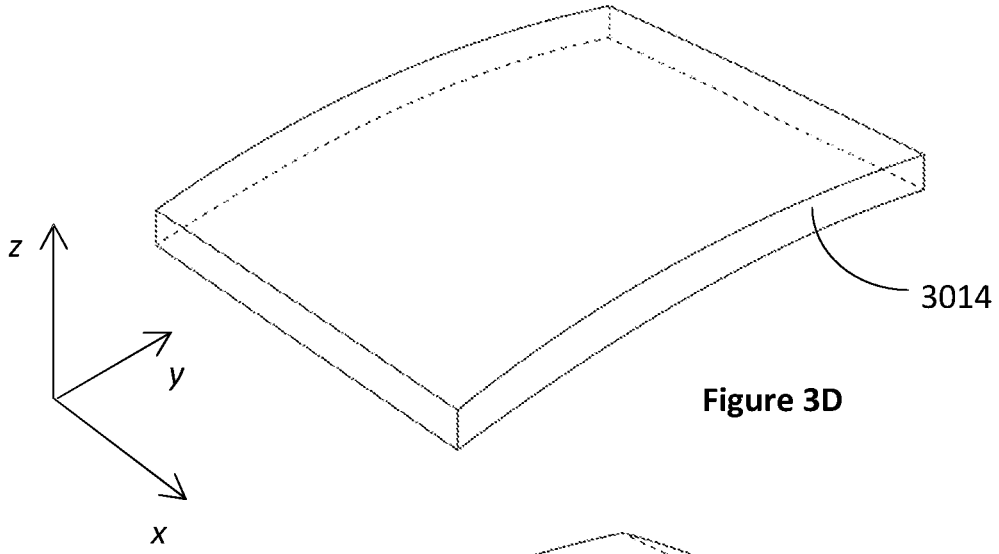
Figure 3E:
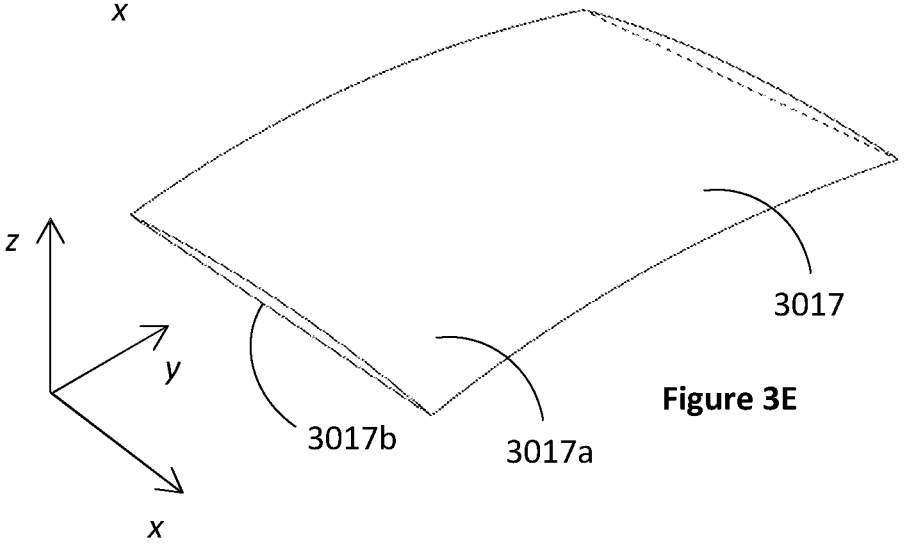

In this embodiment, the display module 3012 includes a protective plastics material layer 3016, and an at least partially optically clear layer 3017 positioned above the protective plastics material layer 3016 as shown in FIGS. 3A and 3B. Protective plastics material layer 3016 is optional—alternatively only the partially optically clear layer 3017 (which may be made of optically clear plastics material) is provided. FIGS. 3C to 3E show perspective views of the outer shell 3002 including the recess 3006, the display module 3012, and the at least partially optically clear layer 3017 respectively.

The at least partially optically clear layer 3017 and the optional protective plastics material layer 3016 may be formed by applying a clear polymerizable material (such as clear epoxy resin, or clear polyester resin, or clear polyurethane resin, or other polymer) over the in situ display screen 3014, which can be smoothed to the correct profile after hardening. Alternatively, the at least partially optically clear layer 3017 and the optional protective plastics material layer 3016 may be pre-formed from a hard clear polymer—e.g., by machining a solid block of hard polymer, injection moulding the polymer, or using additive manufacture (3D printing)—that is glued to the surface of the display screen 3014 using optically clear adhesive, either before or after fitting the flexible display screen 3014 to the recess 3006.

The recess 3006 of the crash helmet 3000 of the embodiment of FIGS. 3A to 3E has walls 3006 that are substantially perpendicular to the portions of the outer shell 3002 and the floor 3008 proximate to the periphery of the recess 3006. The display screen 3014 and at least partially optically clear layer 3017 form an interference fit inside the recess 3006. Advantageously, this arrangement ensures that the display module 3012 and recess occupy a minimal surface area of the helmet.

As shown in FIGS. 3A, 3B and 3E, at least partially optically clear layer 3017 has an outer surface 3017*a*, which is curved in both the first plane xz and the second plane zy. This advantageously provides the display module 3012 with an outer surface that can follow the profile of the outer shell 3002, even when the profile of the outer shell 3002 includes compound curves. This is particularly beneficial, as flexible displays may have limited or no ability to bend around more than one axis simultaneously without risking damage to the flexible display. For example, as shown in FIGS. 3A, 3B and 3E, an inner surface 3017*b* of the at least partially optically clear layer 3017 has a curvature in the second plane yz but not in the first plane xz, such that the inner surface 3017*b* can conform to the surface of the flexible display, while the outer surface 3017*a* can follow the profile of the outer shell 3002. It is noted that by ensuring that the flexible display screen 3014 is curved in one plane, so as to substantially match or closely follow the curvature of the outer shell 3002 of the helmet in that plane, the total volume required to accommodate the display module 3012 is reduced. Further, by following the curve of the helmet 3000 in one direction with the flexible display screen 3014, the display module can be positioned closer to the outside final surface, thereby reducing the amount of clear material between the viewer and the display surface—this advantageously reduces distortion and other undesirable optical effects due to refraction.

The plane about which the flexible display screen 3014 is curved can be chosen according to a number of factors, including the profile of the helmet, the orientation of the display screen, the direction in which the flexible display 3014 demonstrates the best flexing properties, and the location of other components (e.g., a display controller, other electronics, or cabling).

The at least partially optically clear layer 3017 can include voids (not shown) In one or more portions that do not sit directly over the flexible display screen 3014. Advantageously this reduces the overall weight of the display module 3012.

Figure 4A:
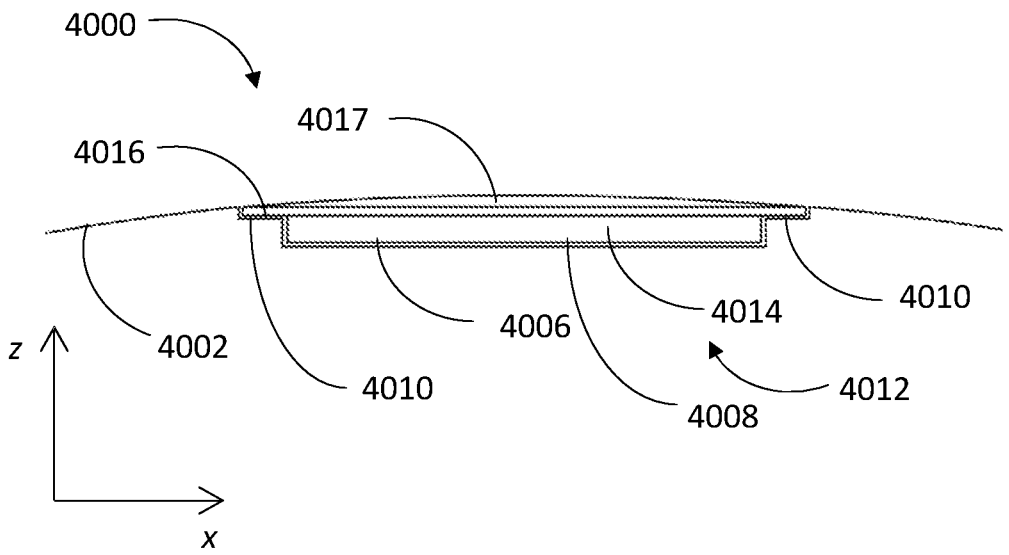
FIG. 4A shows a schematic cross section of portion of a crash helmet along a first axis according to an embodiment of the invention.
Figure 4B:
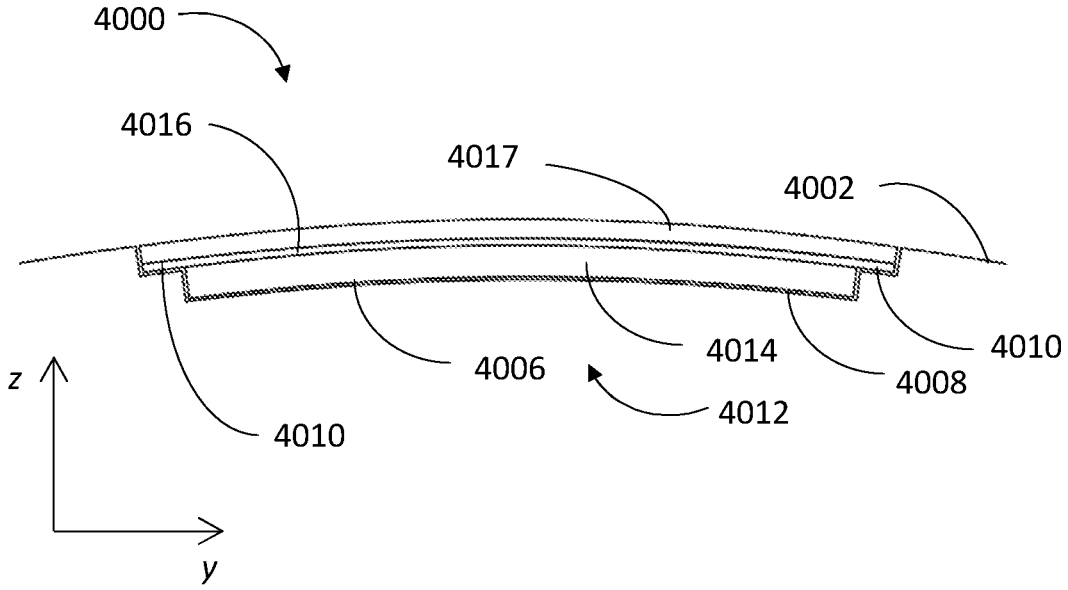
FIG. 4B shows a schematic cross section of a portion of the crash helmet of FIG. 4A along a second axis perpendicular to the first axis.

FIGS. 4A and 4B illustrate another arrangement that can be used instead of or in conjunction with the embodiments above. FIG. 4A shows a schematic cross section of portion of a crash helmet 4000 along a first axis, i.e., in a first plane xz. FIG. 4B shows a cross section of the same crash helmet 4000 along a second axis perpendicular to the first axis, i.e. in a second plane yz orthogonal to the first plane xz. The crash helmet 4000 includes an outer shell 4002 having a recess 4006 for housing a display module 4012. The display module 4012 includes a flexible display screen 4014 and an at least partially optically clear layer 4017 (and optionally a further protective optically clear plastics layer 4016).

The crash helmet 4000 is as described above in relation to the crash helmet 3000 of FIGS. 3A to 3E (in particular the at least partially optically clear layer 4017 has an outer surface with curvature in both xz and yz planes), with the exception that the recess 4006 includes a step 4010. The step 4010 is analogous to the step 210 described in relation the embodiment of FIGS. 2A-2D above, and allows the at least partially optically clear layer 4017 to extend beyond the periphery of the flexible display screen. The at least partially optically clear layer 4017 (or the optional protective optically clear plastics layer 4016) may be attached directly to the step 4010, for example by a suitable adhesive (not shown). Advantageously this arrangement provides a convenient means for securing the display module 4012 to the recess 4006 while protecting the flexible display screen 4014. Further, the need for adhesive/other attachment means to directly attach the display screen 4014 or other components to the helmet 4000 is avoided.

Again, the at least partially optically clear layer 4017 and the optional protective plastics material layer 4016 may be formed by applying a clear polymerizable material (such as clear epoxy resin, or clear polyester resin, or clear polyurethane resin, or other polymer) over the in situ display screen 4014, which can be smoothed to the correct profile after hardening. Alternatively, the at least partially optically clear layer 4017 and the optional protective plastics material layer 4016 may be pre-formed from a hard clear polymer—e.g., by machining a solid block of hard polymer, injection moulding the polymer, or using additive manufacture (3D printing)—that is glued to the surface of the display screen 4014 using optically clear adhesive, either before or after fitting the flexible display screen 4014 to the recess 4006.

Figure 5A:
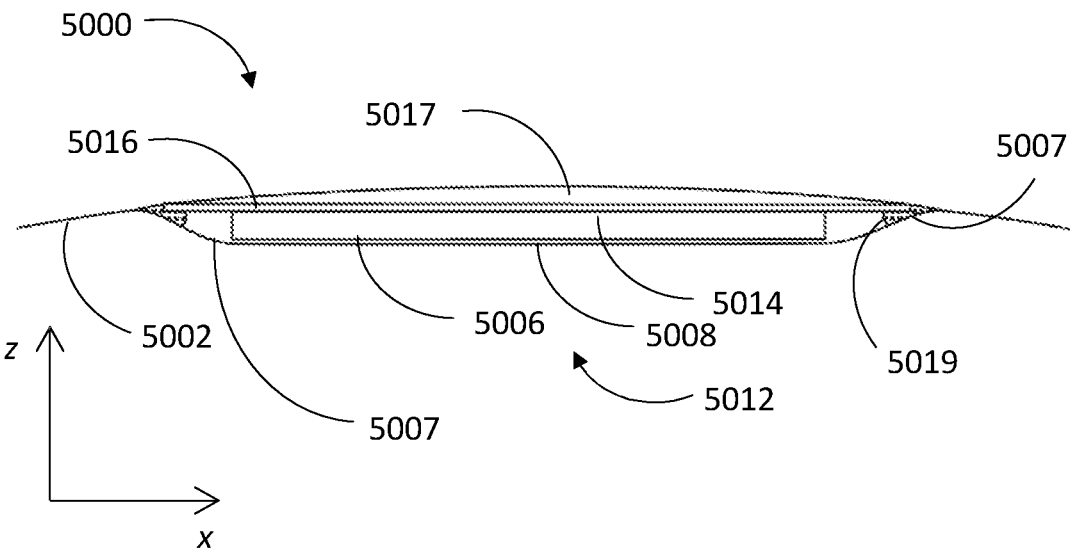
FIG. 5A shows a schematic cross section of portion of a crash helmet along a first axis according to an embodiment of the invention.
Figure 5B:
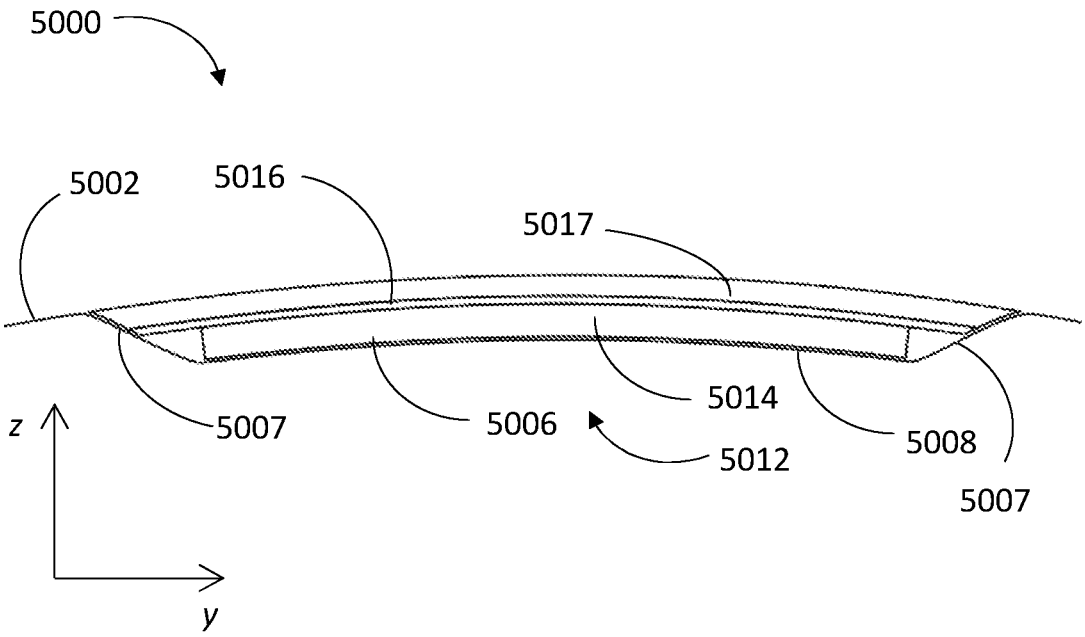
FIG. 5B shows a schematic cross section of a portion of the crash helmet of FIG. 5A along a second axis perpendicular to the first axis.

FIGS. 5A and 5B illustrate another arrangement that can be used instead of or in conjunction with the embodiments above. FIG. 5A shows a schematic cross section of portion of a crash helmet 5000 along a first axis, i.e., in a first plane xz. FIG. 5B shows a cross section of the same crash helmet 5000 along a second axis perpendicular to the first axis, i.e., in a second plane yz orthogonal to the first plane xz. The crash helmet 5000 includes an outer shell 5002 having a recess 5006 for housing a display module 5012. The display module 5012 includes a flexible display screen 5014 and an at least partially optically clear layer 5017 (and optionally a further protective optically clear plastics layer 5016).

The crash helmet 5000 is as described above in relation to the crash helmet 3000 of FIGS. 3A to 3E (in particular the at least partially optically clear layer 5017 has an outer surface with curvature in both xz and yz planes), with the exception of the shape of the recess 5006. The recess 5006 of the crash helmet 5000 of the embodiment of FIGS. 5A and 5B has walls 5007 that are angled, such that the walls lie at an obtuse angle with respect to both the outer shell 5002 and the floor 5008 proximate to the periphery of the recess 5006. In this arrangement, the at least partially optically clear layer 4017 extends beyond the periphery of the flexible display screen 5014 (e.g., along the x and y axes as shown). Advantageously, by providing such angled walls 5007, the number of stress raising points induced during manufacture of the helmet is reduced. This in turn means that less material is required to produce a helmet having a required strength, reducing both weight and materials cost.

The at least partially optically clear layer 5017 (or protective optically clear plastics layer 5016, if provided) is secured directly to the recess walls 5007 by means of a suitable adhesive 5019, providing a convenient attachment means and avoiding the need to use adhesive/other attachment means to directly attach the display screen 5014 or other components to the helmet 5000.

Again, the at least partially optically clear layer 5017 and the optional protective plastics material layer 5016 may be formed by applying a clear polymerizable material over the in situ display screen 5014, which can be smoothed to the correct profile after hardening, or may be pre-formed from a hard clear polymer that is glued to the surface of the display screen 5014 using optically clear adhesive, either before or after fitting the flexible display screen 5014 to the recess 5006.

Figure 6A:
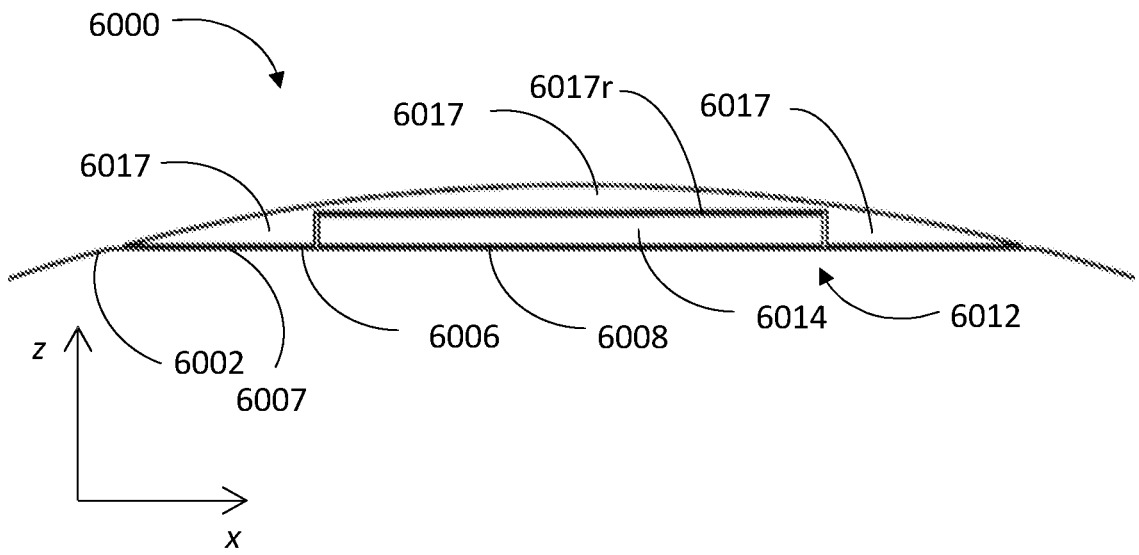
FIG. 6A shows a schematic cross section of portion of a crash helmet along a first axis according to an embodiment of the invention.
Figure 6B:
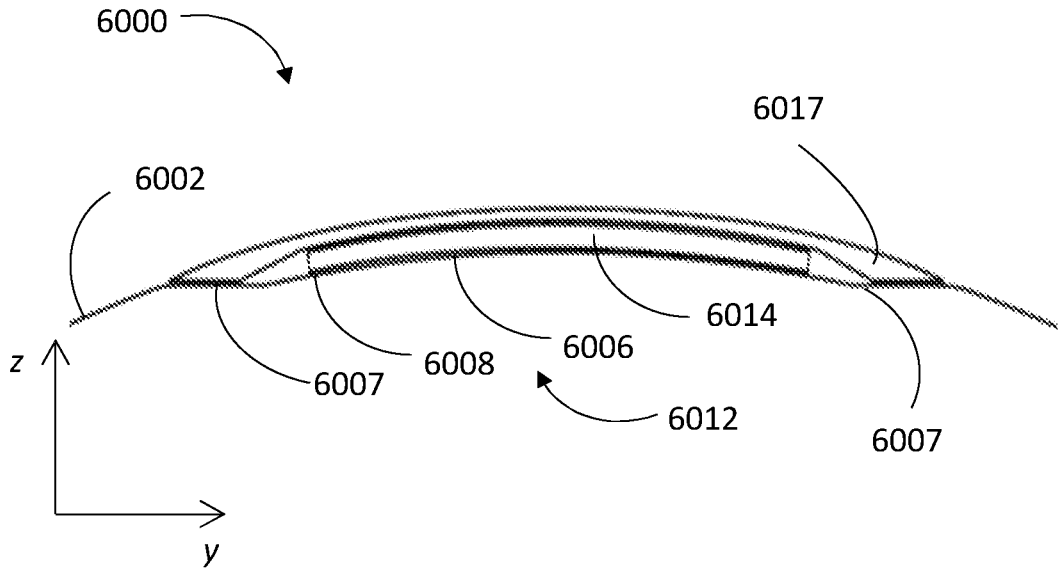
FIG. 6B shows a schematic cross section of a portion of the crash helmet of FIG. 6A along a second axis perpendicular to the first axis.
Figure 6C:
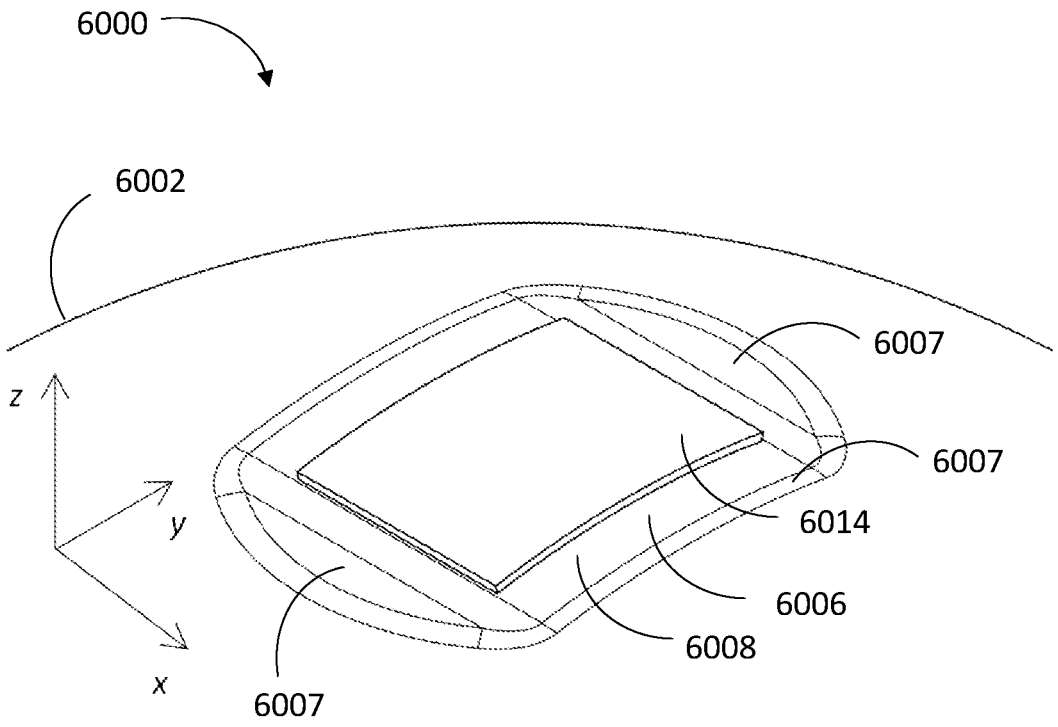
FIG. 6C shows a perspective view of a portion of a partly assembled crash helmet according to the embodiment of FIGS. 6A and 6B.

FIGS. 6A to 6C illustrate another arrangement that can be used instead of or in conjunction with the embodiments above. This embodiment is a variation on the embodiment shown in FIGS. 5A and 5B. FIG. 6A shows a schematic cross section of portion of a crash helmet 6000 along a first axis, i.e., in a first plane xz. FIG. 6B shows a cross section of the same crash helmet 6000 along a second axis perpendicular to the first axis, i.e., in a second plane yz orthogonal to the first plane xz. The crash helmet 6000 includes an outer shell 6002 having a recess 6006 for housing a display module 6012. The display module 6012 includes a flexible display screen 6014 and an at least partially optically clear layer 6017 (and optionally a further protective optically clear plastics layer—not shown).

The crash helmet 6000 is as described above in relation to the crash helmet 5000 of FIGS. 5A and 5B (in particular the at least partially optically clear layer 6017 has an outer surface with curvature in both xz and yz planes), with the exception of the shape of the recess 6006. In this embodiment the recess 6006 is shaped such that the walls 6007 are substantially level with the floor 6008 of the recess 6006 in at least one plane as shown in FIG. 6A. A perspective view shown the helmet 6000 and recess 6006, and display screen 6014 is shown in FIG. 6C (the at least partially optically clear layer 6017 is omitted for clarity). Advantageously, by providing such angled walls 5007, the number of stress raising points induced during manufacture of the helmet is further reduced, meaning that even that less material is required to produce a helmet having a required strength, further reducing both weight and materials cost.

The at least partially optically clear layer 6017 (or protective optically clear plastics layer 6016, If provided) is secured directly to the recess walls 6007 by means of a suitable adhesive 6019, providing a convenient attachment means and avoiding the need to use adhesive/other attachment means to directly attach the display screen 6014 or other components to the helmet 6000.

Again, the at least partially optically clear layer 6017 and the optional protective plastics material layer 6016 may be formed by applying a clear polymerizable material over the in situ display screen 6014, which can be smoothed to the correct profile after hardening, or may be pre-formed from a hard clear polymer that is glued to the surface of the display screen 6014 using optically clear adhesive, either before or after fitting the flexible display screen 6014 to the recess 6006.

In the embodiments of FIGS. 5A to 6C, the respective at least partially optically clear layers 5017, 6017, which extend beyond the periphery of the respective display screens 5014, 6014, may optionally be provided with a recessed portion 6017*r* as shown in FIG. 6A. Advantageously this further assists in retaining the flexible display screen 5014, 6014 while ensuring that the display module 5012, 6012 continues the profile of the outer shell 5002, 6002. Optionally, an optically clear adhesive can be used to fix the display screen 6014 (and optionally other components of the display module 6012) into the recessed portion 6017*r*.

Figure 7A:
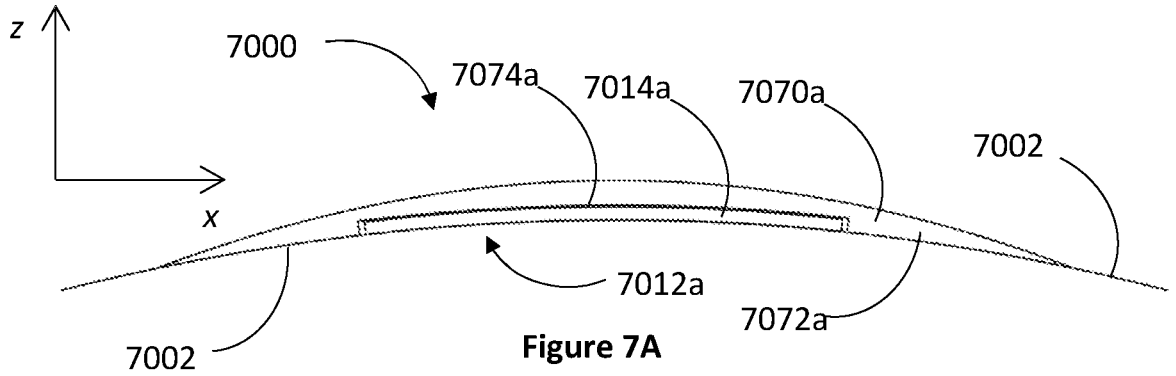
FIG. 7A shows a schematic cross section of portion of a crash helmet including a display attachment along a first axis according to an embodiment of the invention.
Figure 7B:
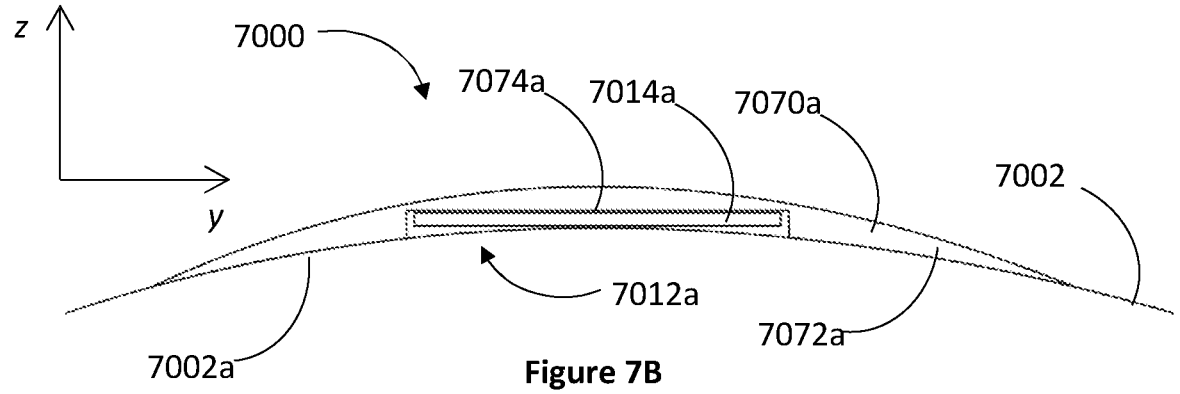
FIG. 7B shows a schematic cross section of a portion of the crash helmet of FIG. 7A along a second axis perpendicular to the first axis.
Figure 7C:
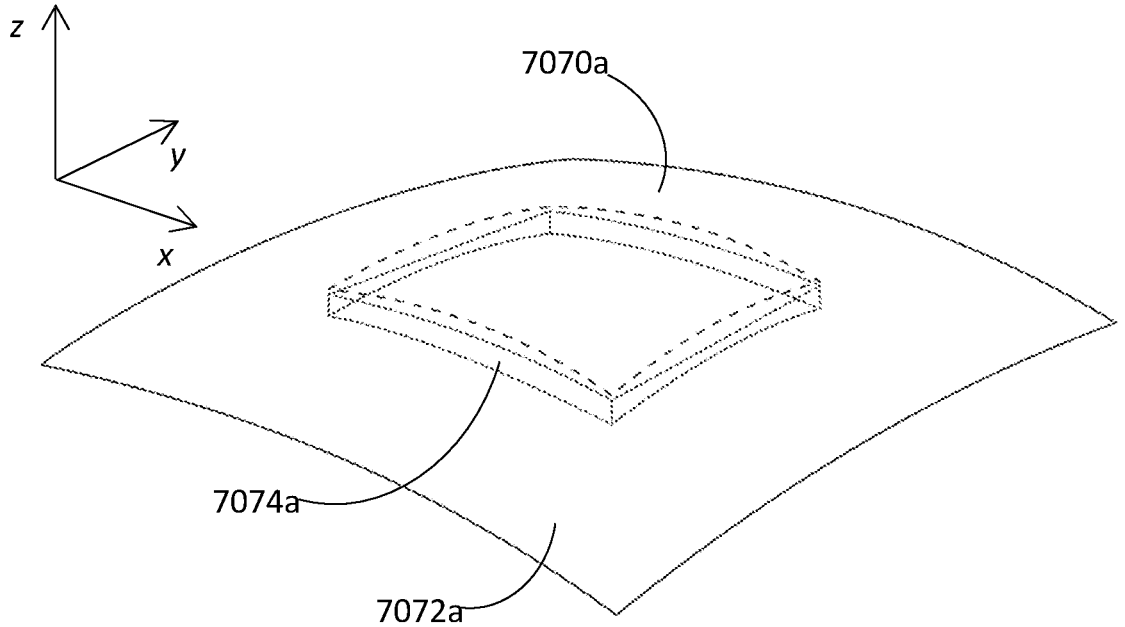
FIG. 7C shows a perspective view of a housing of the display attachment of FIGS. 7A and 7B.
Figure 7D:
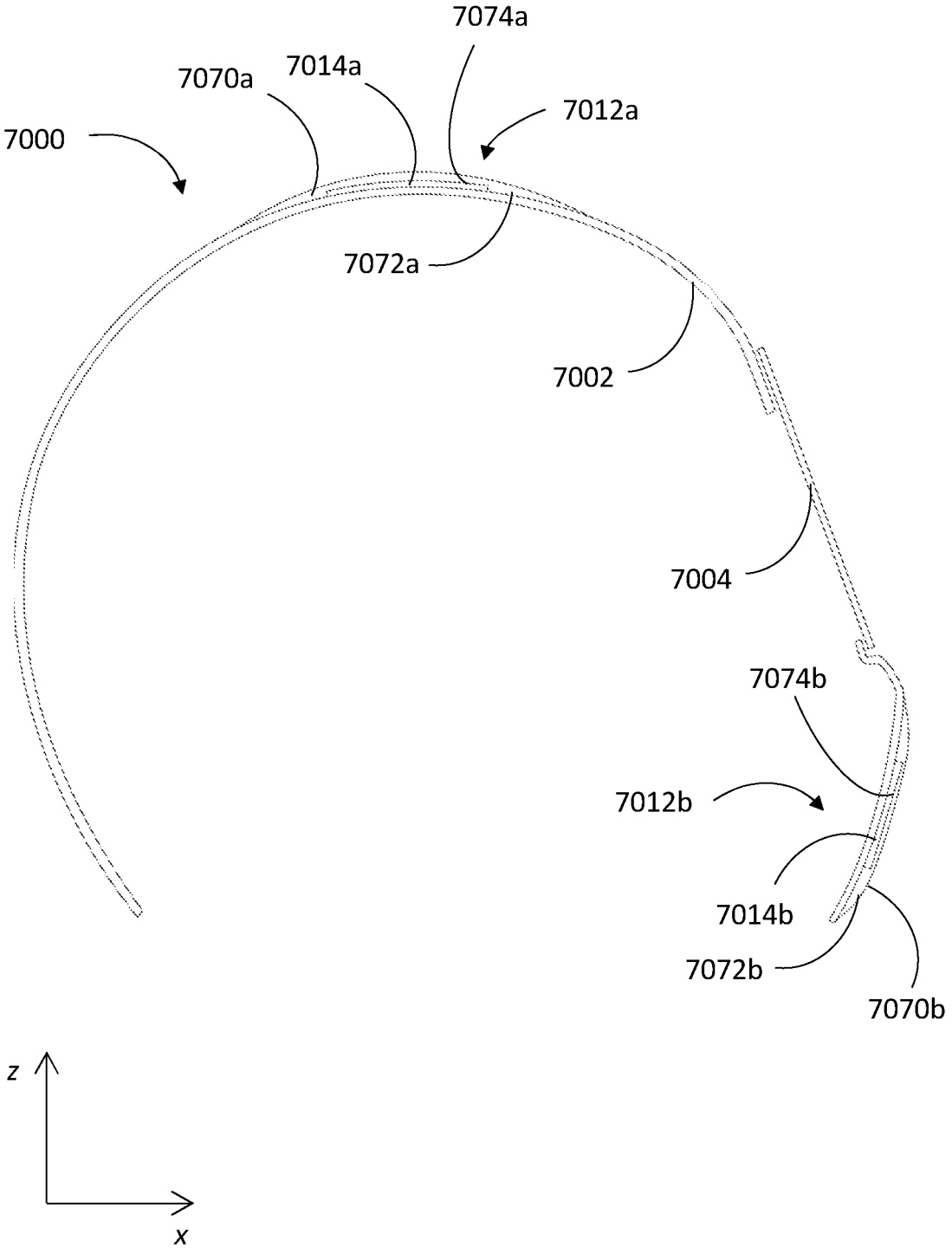
FIG. 7D shows a cross section of the crash helmet of FIGS. 7A to 7B.
Figure 8A:
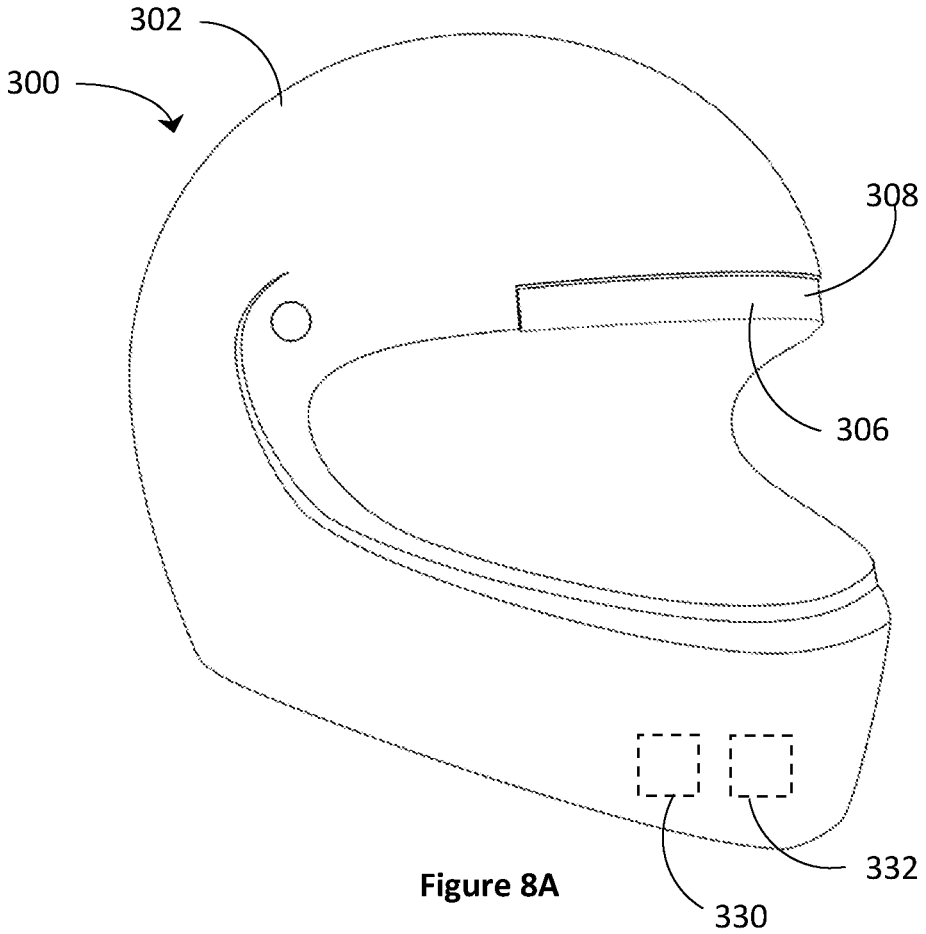
FIG. 8A shows a perspective view of a protective helmet including a recess for accommodating a display module in accordance with an embodiment of the present invention.
Figure 8B:
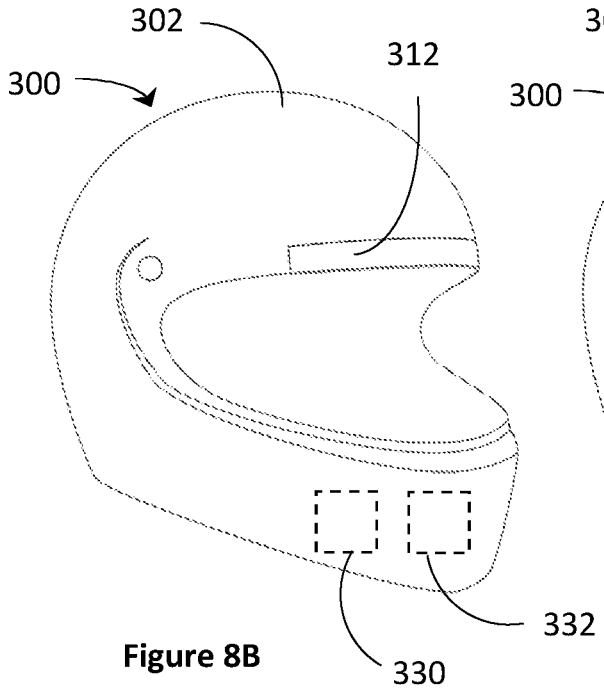
FIGS. 8B and 8C show perspective views of the helmet of FIG. 3A with a display module installed, in accordance with an embodiment of the present invention.
Figure 8C:
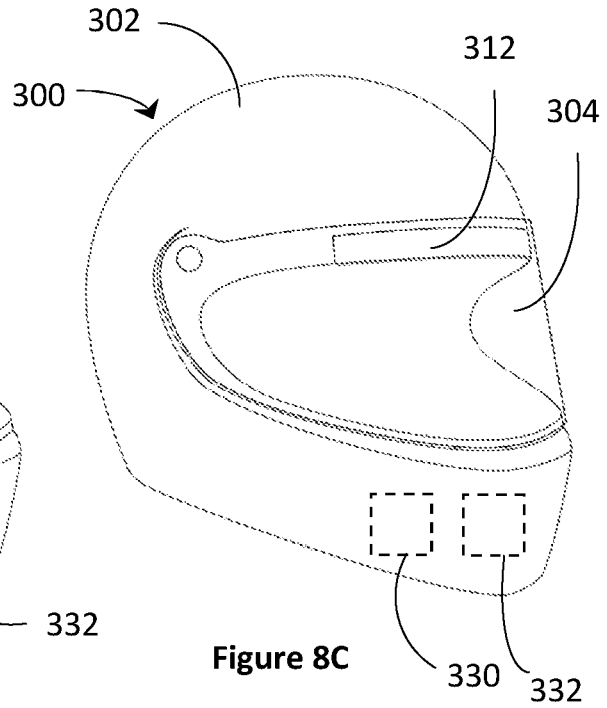
Figure 8D:
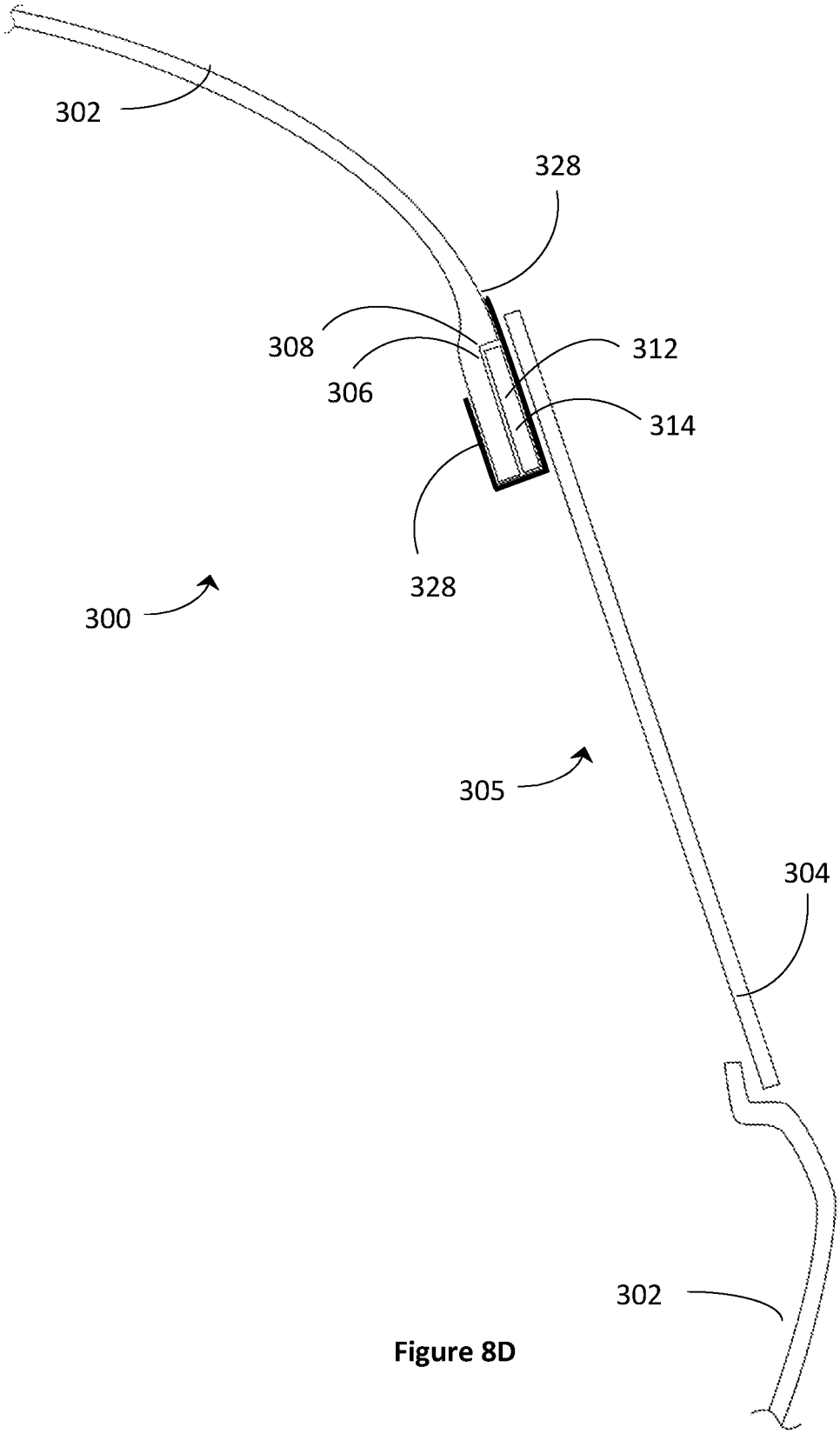
FIG. 8D shows a partial cross section of the crash helmet of FIG. 3C, in accordance with an embodiment of the present invention.

FIGS. 7A to 7D illustrate another arrangement that can be used instead of or in conjunction with the embodiments above. FIG. 7A shows a schematic cross section of portion of a crash helmet 7000 along a first axis, i.e., in a first plane xz. FIG. 7B shows a cross section of the same crash helmet 7000 along a second axis perpendicular to the first axis, i.e., in a second plane yz orthogonal to the first plane xz. FIG. 7D shows a cross section of the helmet 7000 including two display modules 7012*a*, 7012*b*. The crash helmet 7000 includes an outer shell 7002. This embodiment differs from those described above, in that the display modules 7012*a*, 7012*b* take the form of attachments 7070*a*, 7070*b* suitable for retrofitting to an otherwise unmodified portion of a crash helmet 7000. The attachments 7070*a*, 7070*b* include an at least partially optically clear housing 7072*a*, 7072*b* shaped to substantially continue the profile of the outer shell 7002. A flexible display screen 7014*a*, 7014*b* is housed within a recess 7074*a*, 7074*b* in the housing 7072*a*, 7072*b*. A perspective view of the housing 7072*a* is shown in FIG. 7C.

Similar to the at least partially optically clear layers 3017, 4017, 5017 6017 of the embodiments of FIGS. 3A-6C, the at least partially optically clear housing 7072*a*, 7072*b* has an outer surface with curvature in both xz and yz planes. The housing recess 7074*a*, 7074*b* preferably has a curvature in a first plane but not in an orthogonal plane (as shown in FIGS. 7A to 7C). Accordingly, the housing 7072*a*, 7072*b* provides an outer surface that can continue a compound curved profile of the helmet 7000, while allowing the flexible display screen to bend in only a single plane, thereby minimising total volume and avoiding damaging bending of the flexible display screen 7014*a*, 7014*b*.

The at least partially optically clear housing 7072*a*, 7072*b* may be pre-formed from a hard clear polymer—e.g., by machining a solid block of hard polymer, injection moulding the polymer, or using additive manufacture (3D printing)—that is glued to the surface of the display screen 7014*a*, 7014*b* using optically clear adhesive, either before or after fitting the flexible display screen 7014*a*, 7014*b* to the recess 7072*a*, 7072*b*.

The recess 7072*a*, 7072*b* is preferably shaped so as to provide an interference fit with the flexible display screen 7014*a*, 7014*b*. The viewable face of the flexible display screen 7014*a*, 7014*b* may be fixed to the recess 7072*a*, 7072*b* via optically clear adhesive.

A display controller is preferably provided either as part of the display module 7012*a*, 7012*b* (such as the display controllers 218*a*, 218*b* as described above in relation to the embodiment of FIGS. 2A-2D, or remote from the display module. If remote from the display module 7012*a*, 7012*b*, then a suitable further recess can be included to route cabling between the display controller and the display screen 7014*a*, 7014*b*. Similarly, sensors (not shown) can also be provided, as described in relation to the proximity 230 and environmental sensors 232 of the embodiment of FIGS. 2A-2D.

Although shown as having a substantially rectangular viewable area in FIGS. 2A to 7C, the display module 212, 3012, 4012, 5012, 6012, 7012, in particular the flexible electronic display 214, 3014, 4014, 5014, 6014, 7014 may be any shape. Advantageously, in the context of the embodiments of FIGS. 2A to 7C, the display module 212, 3012, 4012, 5012, 6012, 7012 is preferably shaped so as to conform to the profile of a portion of the helmet 200, 3000, 4000, 5000, 6000, 7000 and any applicable attachments, thereby increasing the viewable area of the display module 212, 3012, 4012, 5012, 6012, 7012. For example, a flexible electronic display flexible electronic display 214, 3014, 4014, 5014, 6014, 7014 may be optionally be shaped so as to follow a profile of an opening corresponding to a visor, extend around vent or aerodynamic attachments, extend around fixtures/hinges for a visor, etc.

FIGS. 8A to 8D show an alternative/additional arrangement to that shown in FIGS. 2A-2D. The crash helmet 300 includes an outer shell 302, for example an outer shell of protective material (such as fibreglass, carbon fibre, Kevlar or polycarbonate) as known in the art. The helmet 300 preferably includes a visor 304 as known in the art, which may optionally include an anti-fog layer as known in the art. The helmet 300 also includes interior shock absorbing material (such as expanded polystyrene) as known in the art (not shown for clarity). Again, a recess 306 is provided in an outer shell 302 of a helmet 300. Again, the recess 306 has a floor 308 and may optionally be provided with a step (not shown) analogously to the arrangement shown in FIGS. 2A to 2D. In this arrangement, the recess 306 is provided proximate to a top edge of a visor aperture 305 (FIGS. 8A and 8B omit the visor 304 for clarity; the visor 304 is shown in a closed position in FIG. 8C).

A display module 312 comprising a flexible electronic display screen 314 (preferably a reflective display screen such as e-paper) is positioned within the recess 306. The display module 312 is covered by optically clear visor 304 in use (i.e., when the visor 304 is in a closed position). Advantageously this reduces the need to use further protective plastic layers to cover the display module, as the visor 304 may additionally perform this function. Further, any change to the aerodynamic properties of the helmet 300 due to introducing a display module 312 are avoided, as the outside profile of the helmet 300 is unchanged. Additionally, easy access to the display module 312 is available simply by opening the visor 304 facilitating easy repair, maintenance, or replacement of the display module 312 if required. Although shown as having a substantially rectangular viewable area in FIGS. 8B to 8D, the display module 312 may be any shape. Advantageously, the display module 312 is preferably shaped so as to follow a portion of the outer shell 302 proximate to the edge of the opening 305, increasing the viewable area of the display module 312.

Conveniently, the display module 312 may be fixed in place by means of an optically clear vinyl wrap 328.

Again, a display controller is provided (not shown), either internal to the helmet 300 remote from the display module 312, as part of the display module 312, or external to the helmet 300, as similarly described in relation to FIGS. 2A to 2D.

The helmet 300 is preferably provided with a proximity sensor 330 and/or an environmental sensor 332, with functionality corresponding to the analogous sensors 230, 232 described above in relation to FIGS. 2A to 2D.

Figure 9A:
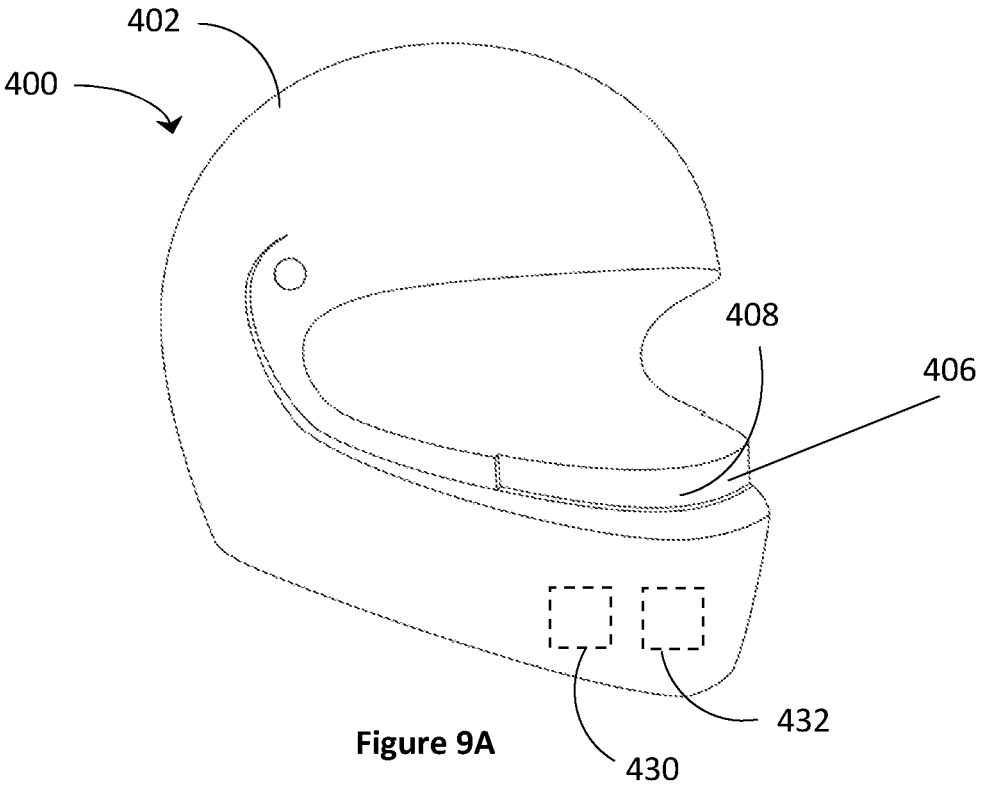
FIG. 9A shows a perspective view of a protective helmet including a recess for accommodating a display module in accordance with an embodiment of the present invention.
Figure 9B:
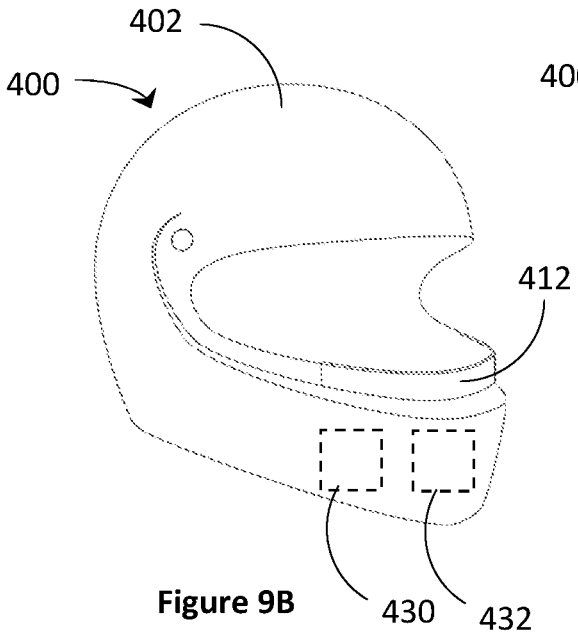
FIGS. 9B and 9C show perspectives view of the helmet of FIG. 4A with a display module installed, in accordance with an embodiment of the present invention.
Figure 9C:
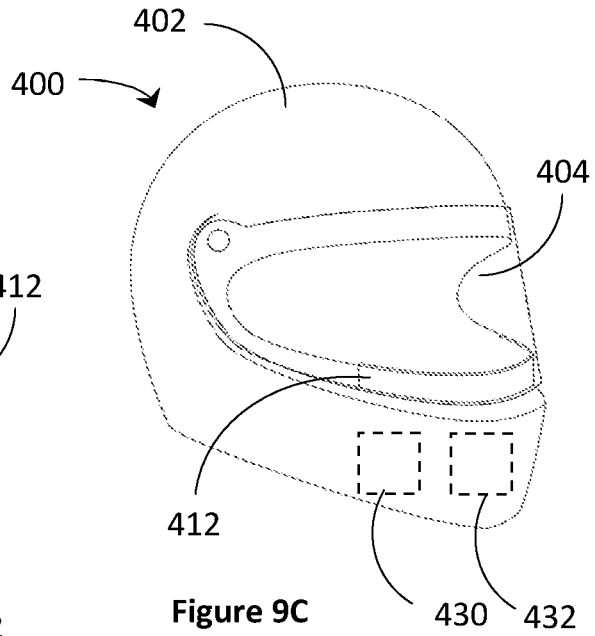
Figure 9D:
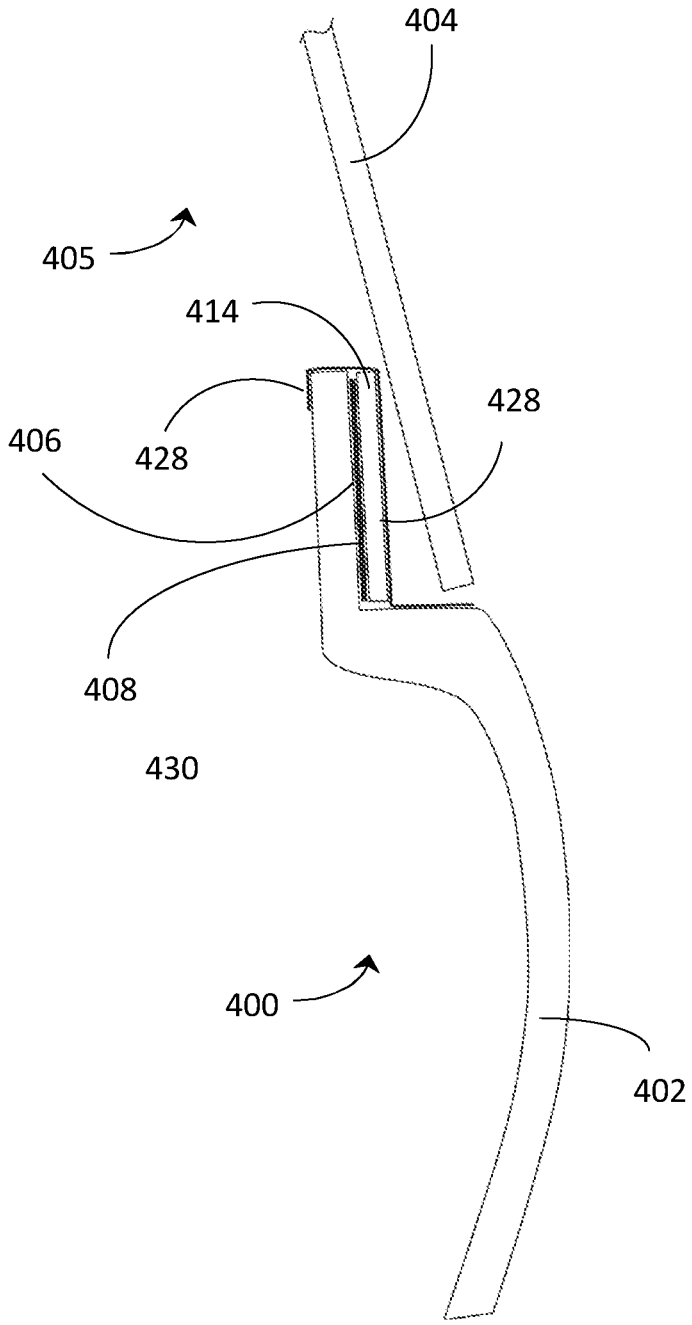
FIG. 9D shows a partial cross section of the crash helmet of FIG. 4C, in accordance with an embodiment of the present invention.

A similar arrangement is shown in FIGS. 9A to 9C. The crash helmet 400 includes an outer shell 402, for example an outer shell of protective material (such as fibreglass, carbon fibre, Kevlar or polycarbonate) as known in the art. The helmet 400 preferably includes a visor 404 as known in the art, optionally including an anti-fog layer. The helmet 400 also includes interior shock absorbing material (such as expanded polystyrene) as known in the art (not shown for clarity). Again, a recess 406 is provided in an outer shell 402 of a helmet 400. Again, the recess 406 has a floor 408 and may optionally be provided with a step (not shown) analogously to the arrangement shown in FIGS. 2A to 2D. In this arrangement, the recess 406 is provided proximate to a bottom edge of a visor aperture 405 (FIGS. 9A and 9B omit the visor 404 for clarity; the visor 404 is shown in a closed position in FIG. 9C).

A display module 412 comprising a flexible electronic display screen 414 (preferably a reflective display screen such as e-paper) is positioned within the recess 406. The display module 412 is covered by optically clear visor 404 in use (i.e., when the visor 404 is in a closed position). Advantageously this reduces the need to use further protective plastic layers to cover the display module, as the visor 404 may additionally perform this function. Further, any change to the aerodynamic properties of the helmet 300 due to introducing a display module 412 are avoided, as the outside profile of the helmet 400 is unchanged. Additionally, easy access to the display module 412 is available simply by opening the visor 404 facilitating easy repair, maintenance, or replacement of the display module 412 if required.

Conveniently, the display module 412 may be fixed in place by means of an optically clear vinyl wrap 428.

Again, a display controller is provided (not shown), either internal to the helmet 300 remote from the display module 412, as part of the display module 412, or external to the helmet 400, as similarly described in relation to FIGS. 2A to 2D.

The helmet 400 is preferably provided with a proximity sensor 430 and/or an environmental sensor 432, with functionality corresponding to the analogous sensors 230, 232 described above in relation to FIGS. 2A to 2D.

Figure 10A:
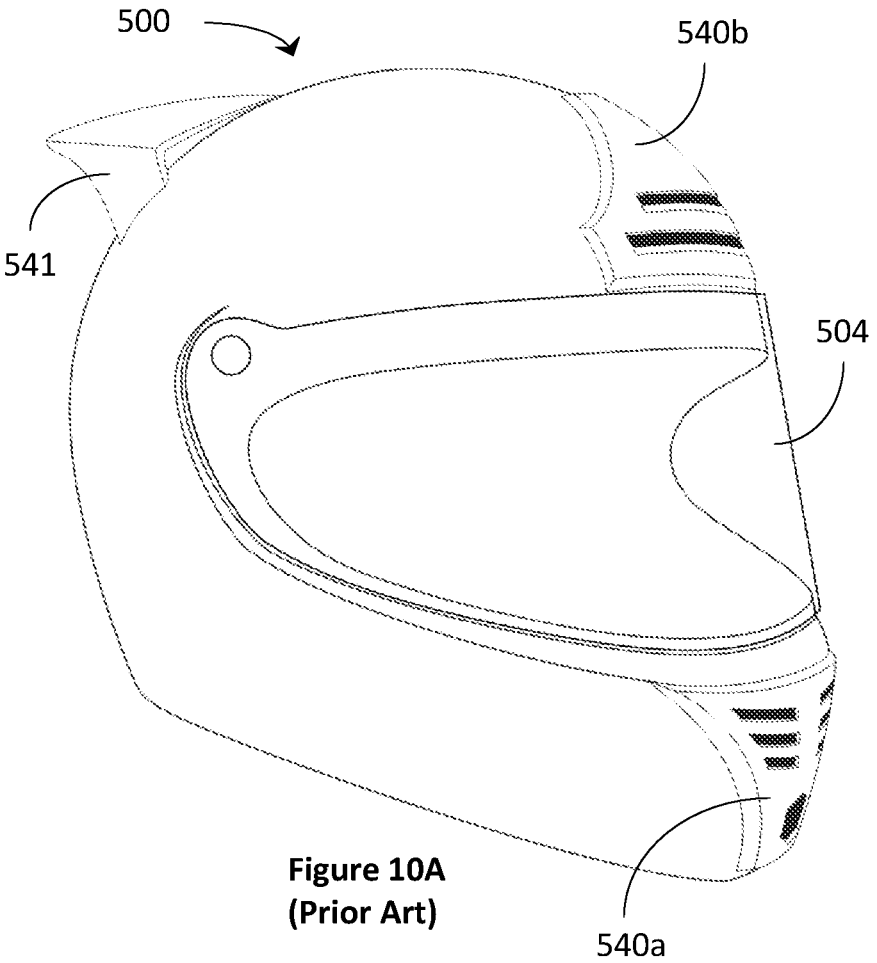
Figure 10A (Prior Art)
FIG. 10A shows a perspective view of a crash helmet including a plurality of attachments as known in the art.
Figure 10B:
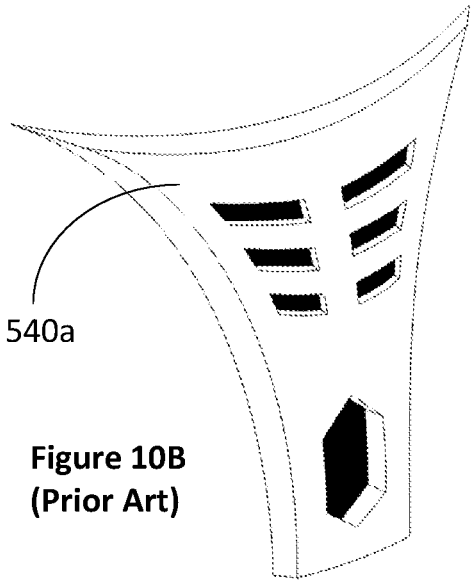
Figure 10B (Prior Art)
FIG. 10B shows a perspective view of a crash helmet vent attachment as known in the art.

FIG. 10A shows a known type of crash helmet 500, with a construction similar to that of the helmet 100 shown in FIGS. 1C to 1C. The helmet 500 additionally includes a variety of helmet attachments, including: a visor 504 configured to cover a visor aperture in use; vent attachments 540*a*, 540*b* covering ventilation apertures in the helmet 500; and an aerodynamic attachment 541 configured to modify the aerodynamic properties of the helmet 500. FIG. 10B shows a known type of vent attachment 540*a*.

FIGS. 11A to 11F show a helmet attachment 640 and helmet 600 including helmet attachments 640*a*, 640*b*, 641 in accordance with a further embodiment of the present invention. Though primarily described with respect to a ventilation (or "vent") attachment 640, It will be appreciated by the skilled person that the provisions below are equally applicable to aerodynamic attachments (such as scoops and spoilers) and other helmet attachments such as visors.

The attachment 640 includes a display module 652, including a flexible electronic display screen 614, which is positioned within the recess 646. The display module 652 is positioned within the recess 646 such that an outer surface 653 of the display module 652 continues a profile of the outer surface 642, providing a continuous surface profile to the attachment 640. For example, the outer surface 653 of the display module may conform to the profile that the outer surface 642 would have had were there no display present. Advantageously, use of a flexible electronic display screen 614 in a display module 652 in such a way allows the use of a display with little or no impact of the aerodynamic properties of the attachment. Preferably, the flexible electronic display is a reflective display as described above in relation to FIGS. 2A to 4D.

The attachment 640 is optionally provided with an optically clear portion 656. The display module 652 is positioned beneath the optically clear portion 656 such that the flexible electronic display 614 is visible through the optically clear portion 656. In this arrangement, an outside surface of the optically clear portion 656 continues a profile of the outer surface 642. The optically clear portion 656 may be a separate panel of optically clear material, in which case the optically clear portion 656 may have an outer surface with a compound curved profile (i.e., be curved in a first plane and in a second plane orthogonal to the first plane) and optionally an inner surface curved only in a first plane, as described above in relation to the at least partially optically clear layers 3017, 4017, 5017, 6017, 7017. Alternatively, the optically clear portion 656 may be part of the bulk material of the attachment itself (for example part of a visor, as described in relation to FIGS. 12 to 17 below).

In some embodiments, the optically clear portion 656 is be formed by applying a clear polymerizable material over the in situ display screen 614, which can be smoothed to the correct profile after hardening, or may be pre-formed from a hard clear polymer that is glued to the surface of the display screen 614 using optically clear adhesive, either before or after fitting the flexible display screen 614 to the recess 646.

Optionally the optically clear portion 656 includes one or more voids, for example voids in portions of the optically clear portion 656 through which the flexible display is not visible, thereby advantageously reducing weight.

Figure 11A:
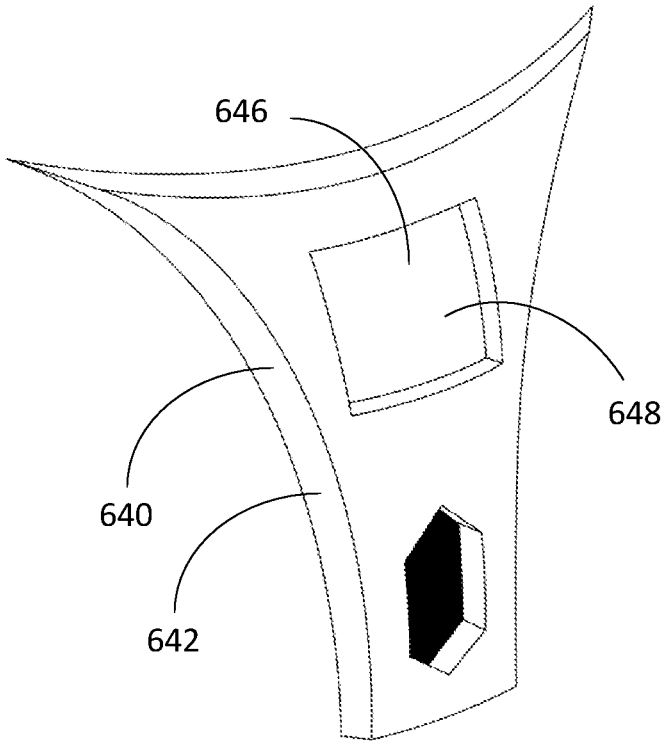
FIGS. 11A and 11B show perspective views of alternative crash helmet vent attachments including recesses for accommodating display modules, in accordance with an embodiment of the invention.
Figure 11B:
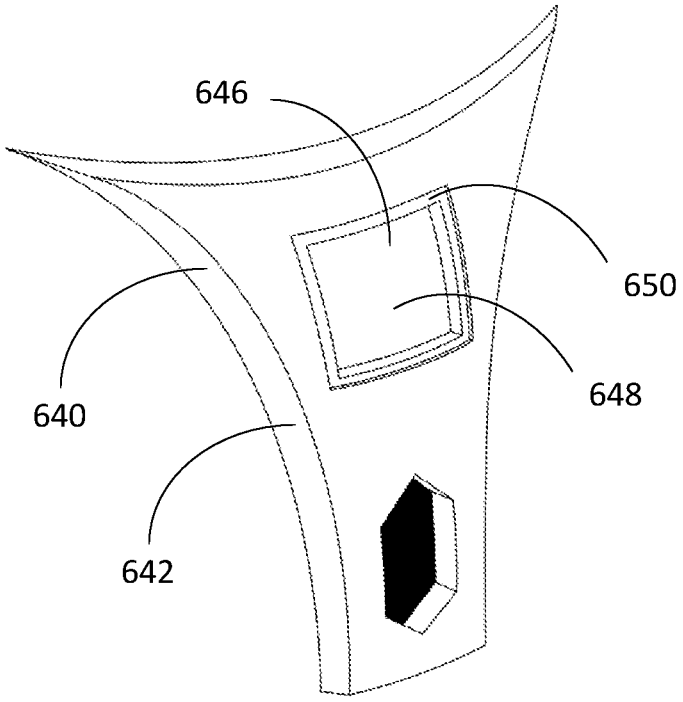

As shown in FIGS. 11A to 11F, the attachment 640 has an outer surface 642. The outer surface 642 includes a recess 646 having a floor 648. Preferably the profile of the floor 648 matches the profile of the outer surface 642 proximate to the recess 646. For example, the floor 608 may have a curvature that is the same or similar to that of the outer surface 642 proximate to the recess 646. Advantageously, this reduces the amount of space taken up by the recess 646. Optionally, the recess 646 includes a step 650 that extends along one or more peripheral edges of the recess 646 as shown in FIG. 11B. The depth of the step is shallower with respect to the outer surface 642 proximate to the recess 606 than the depth of the floor 648 with respect to the outer surface 642 proximate to the recess 646. The function of the step 650 is analogous to the step 210 as described above in relation to FIGS. 2A to 2D. Alternatively, no step is provided, as shown in FIG. 11A.

Figure 11C:
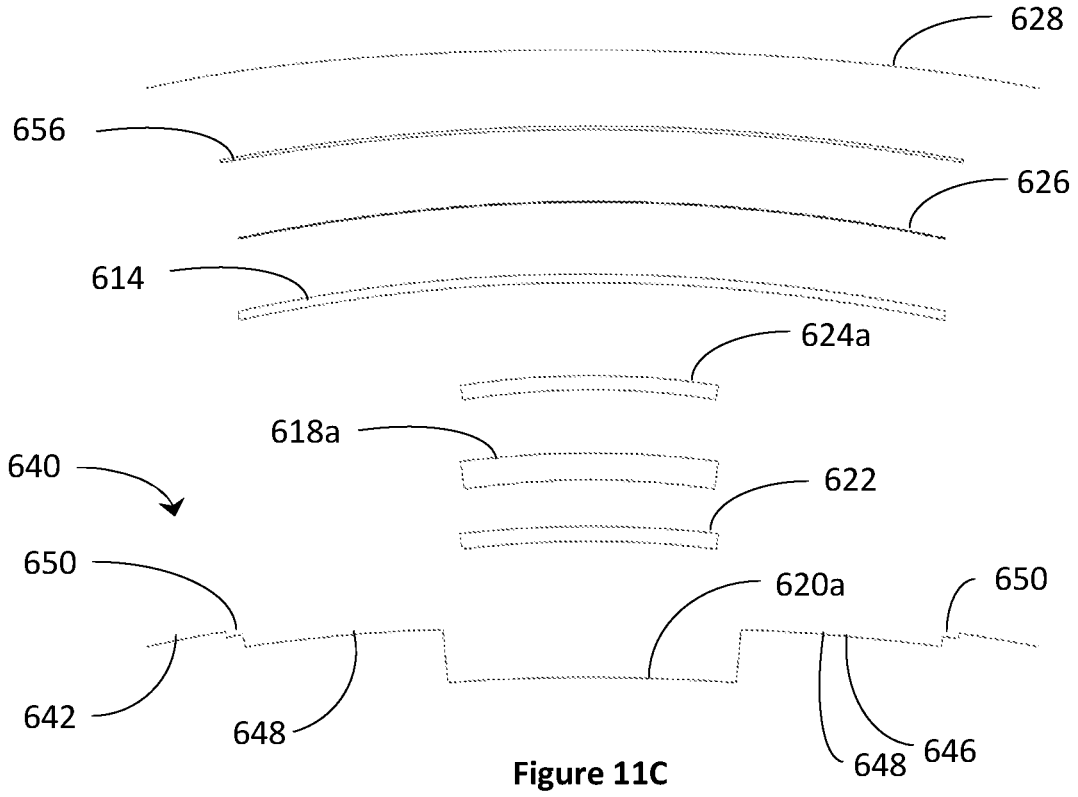
FIGS. 11C and 11D show schematic exploded cross sections of a portion of the crash helmet of FIG. 11B in accordance with two respective alternatives of an embodiment of the present invention.
Figure 11D:
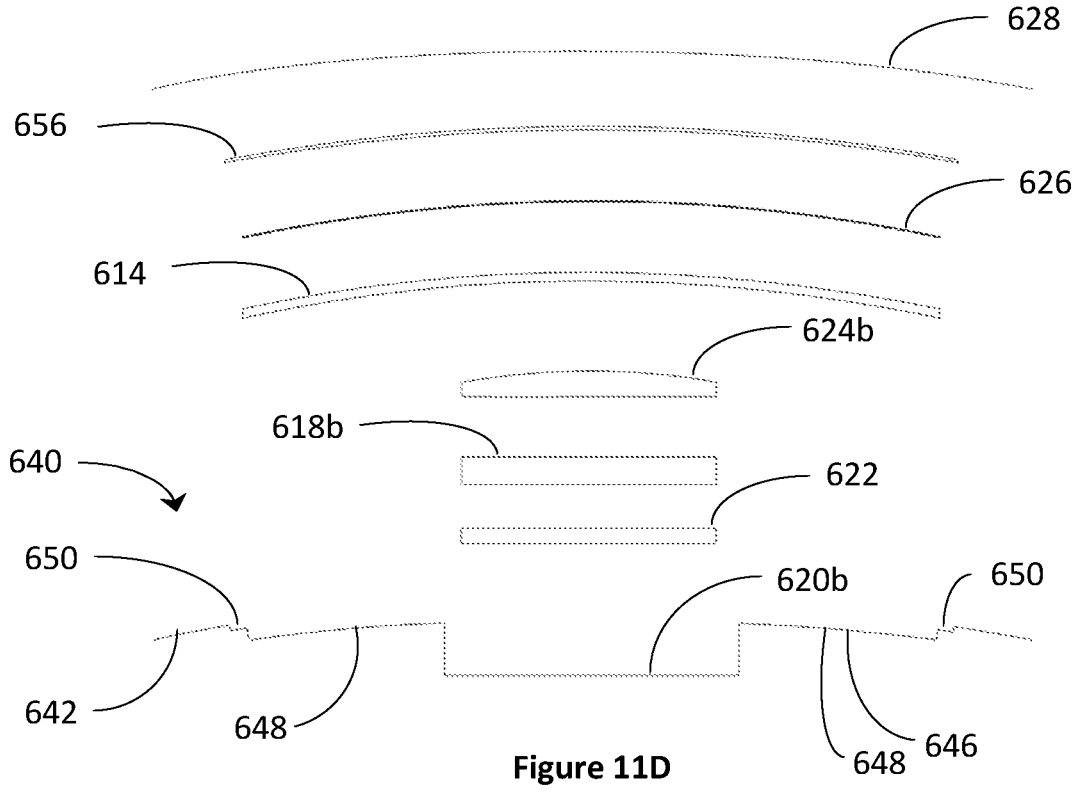
Figure 11E:
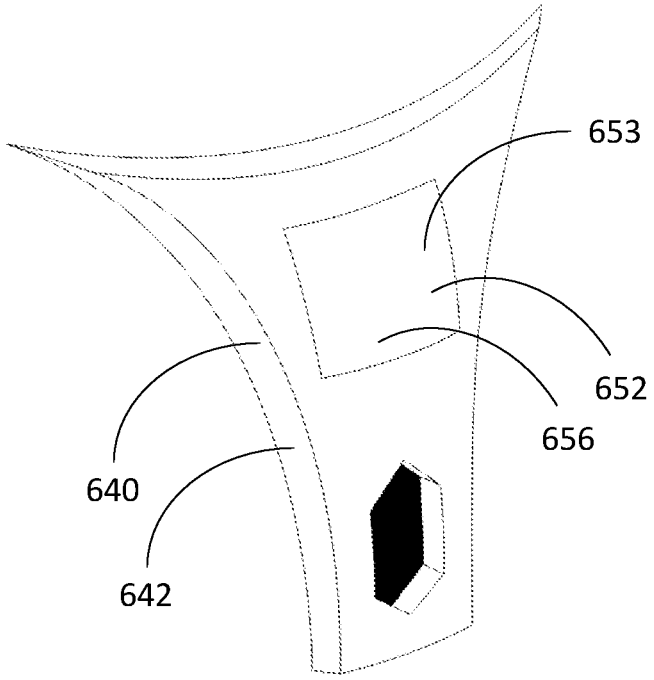
FIG. 11E shows a perspective view of the vent attachment of FIGS. 6A and 6B with a display module installed, in accordance with an embodiment of the present invention.

Preferably, as with the embodiments of FIGS. 2A to 4D above, a display controller 618*a*, 618*b* is also provided. The display controller 618*a*, 618*b* is configured to control the flexible electronic display 614, causing the flexible electronic display to selectively display content. The display controller 618*a*, 618*b* may be provided in the attachment 640 or helmet 600 at a position remote from the display module 652, and communicate with the flexible electronic display means via a wired or wireless connection. Alternatively, the display controller may be provided external to the attachment 640 and helmet 600 (for example in other protective clothing, or in a vehicle associated with the wearer of the helmet), in which case the helmet includes wired or wireless communication means (not shown) to enable the display controller 618*a*, 618*b* to communicate with the flexible electronic display 614. In a more preferred alternative, the display module 652 comprises a display controller 618*a*, 618*b*, as shown in FIGS. 11C and 11D. In embodiments where the display module 652 comprises the display controller 618*a*, 618*b*, a further recess 620*a*, 620*b* is optionally provided within the recess 646 to house the display controller 618*a* 618*b*. Preferably the display controller 618*a* is fabricated on a flexible PCB, in which case the further recess 620*a* may be have a profile matching that of the recess 646 and/or the outer surface 642 proximate to the recess 646 (as shown in FIG. 11C). Alternatively, the display controller 618*b* may be fabricated on a standard (non-flexible) PCB, in which case the profile of the further recess 620*b* is flat, and a shaped support member, such as a shaped adhesive foam member 624*b*, is provided between the display controller 618*b* and the flexible electronic display screen 614 (as shown in FIG. 11D).

In one example, the display controller 618*a*, 618*b* is optionally attached to the further recess 620*a*, 620*b* via a foam layer 622. Preferably foam layer 622 includes an adhesive on the side facing the display controller 618*a*, 618*b*. The flexible electronic display screen 614 is then attached to the display controller 618*a*, 618*b* by means of a double-sided adhesive foam layer 624*a*, 624*b*. The protective optically clear plastics layer 616 may then be attached to the flexible electronic display screen 614 by means of an optically clear adhesive 626, such as an adhesive film (e.g., a double-sided adhesive film or tape), and secured to the step 650 as described above to retain the complete display module 612 within the recess 646. In embodiments where no step 650 is provided, the display module 612 is preferably held in place by an adhesive placed between the recess 646 and the display module 612 (for example between the foam layer 622 and the recess 646). Alternatively, the display module 652 may be pre-assembled on an installation frame/jig that is either flexible, or has a profile matching that of the outer surface 642 proximate the recess 646, then brought into engagement with the recess 626 containing a suitable adhesive (such as a UV curable adhesive), then the installation frame/jig can be removed, leaving the assembled attachment 640.

In the event that any gap is present between the outer surface of the display module 652 at the outer surface 642 after installation, the gap is preferably filled with a smoothable filling medium.

Once the display module 652 has been installed, optionally a layer of at least partially clear vinyl wrap material 628 is applied over the display module, extending over at least a portion of the outer surface 642. This further ensures that the surface profile of the attachment 640 is continuous and without interruptions, thereby retaining good aerodynamic properties. Optionally, the vinyl wrap material 628 may have a printed (for example pre-printed) pattern over a part of its surface, for example a "fade-in" pattern, positioned around a marginal area of the display module 652 and designed to disguise the edge of the display module 652.

Figure 11F:
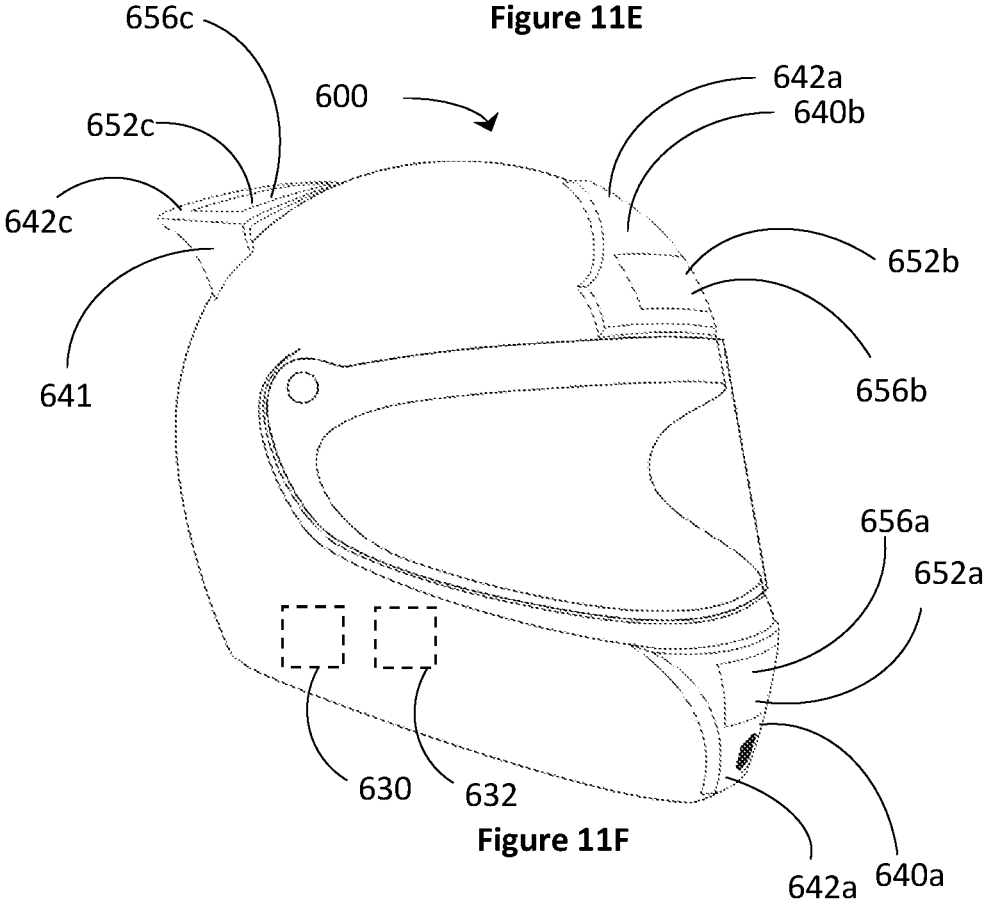
FIG. 11F shows a perspective view of a crash helmet including vent attachments and an aerodynamic attachment having installed display modules, in accordance with an embodiment of the present invention.

FIG. 11F shows a helmet 600 having a plurality of attachments including a first ventilation attachment 640*a*, a second ventilation attachment 640*b* and an aerodynamic attachment (specifically a spoiler) 641. Each attachment 640*a*, 640*b*, 641 includes an outer surface 642*a*, 642*b*, 642*c*, a display module 652*a*, 652*b*, 652*c*, and an optically clear portion 656*a*, 656*b*, 656*c* as described above. The crash helmet 600 includes an outer shell, for example an outer shell of protective material (such as fibreglass, carbon fibre, Kevlar or polycarbonate) as known in the art. The helmet 600 preferably includes a visor as known in the art. The helmet 600 also includes interior shock absorbing material (such as expanded polystyrene) as known in the art (not shown for clarity).

The helmet 600 preferably also includes a proximity sensor 630 and/or an environmental sensor 632 in communication with the display controller 618*a*, 618*b*, with functionality corresponding to the analogous sensors 230, 232 described above in relation to FIGS. 2A to 2D.

In this embodiment, where a wired connection between the display module 652 and other components within the helmet 600 (for example if the display controller was situated within the helmet), cabling is optionally routed through pre-existing holes in the helmet 600, for example ventilation holes present beneath a ventilation attachment 640*a*, 640*b*.

Figure 12:
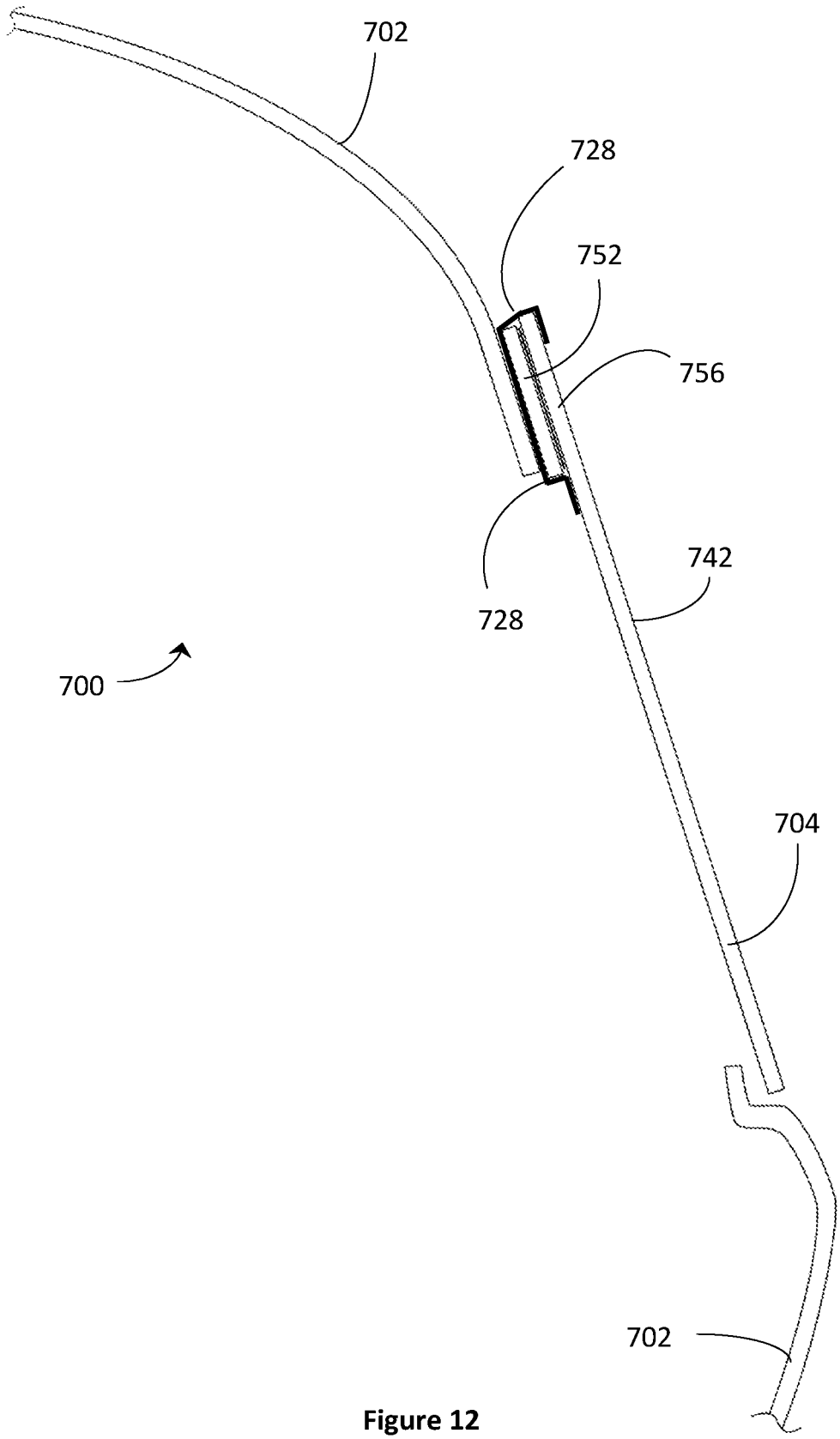
FIG. 12 shows a partial cross section of a crash helmet including a display module installed on a visor, in accordance with an embodiment of the present invention.

A further variation of the helmet attachment is shown in FIG. 12. FIG. 12 shows a partial cross section of a crash helmet 700 including an outer shell 702 of protective material (such as fibreglass, carbon fibre, Kevlar or polycarbonate) and a visor 704. The visor 704 may optionally include an anti-fog layer (not shown) as known in the art. The helmet 700 also includes interior shock absorbing material (such as expanded polystyrene) as known in the art (not shown for clarity). The visor 704 comprises a display module 752 positioned beneath an optically clear portion 756 of the visor 704, proximate to a top of the visor. Preferably the full extent of the visor 704 is optically clear. The display module 752 is preferably as described above in relation to any of FIGS. 2A to 11F, and includes a flexible electronic display screen (preferably a reflective display screen) visible through the optically clear portion 756 of the visor 704. The display module 752 is preferably curved so as to conform to the inside surface of the optically clear portion 756 of the visor 704, advantageously requiring little, if any modification of the outer shell 702 to accommodate the display module 752 when the visor 704 is closed. Advantageously, the visor 704 itself provides protection for the display module 752 without the need for additionally protective optically clear plastic layers. Optionally, the display module is fixed to the visor 704 by means of vinyl wrap material 728.

Figure 13:
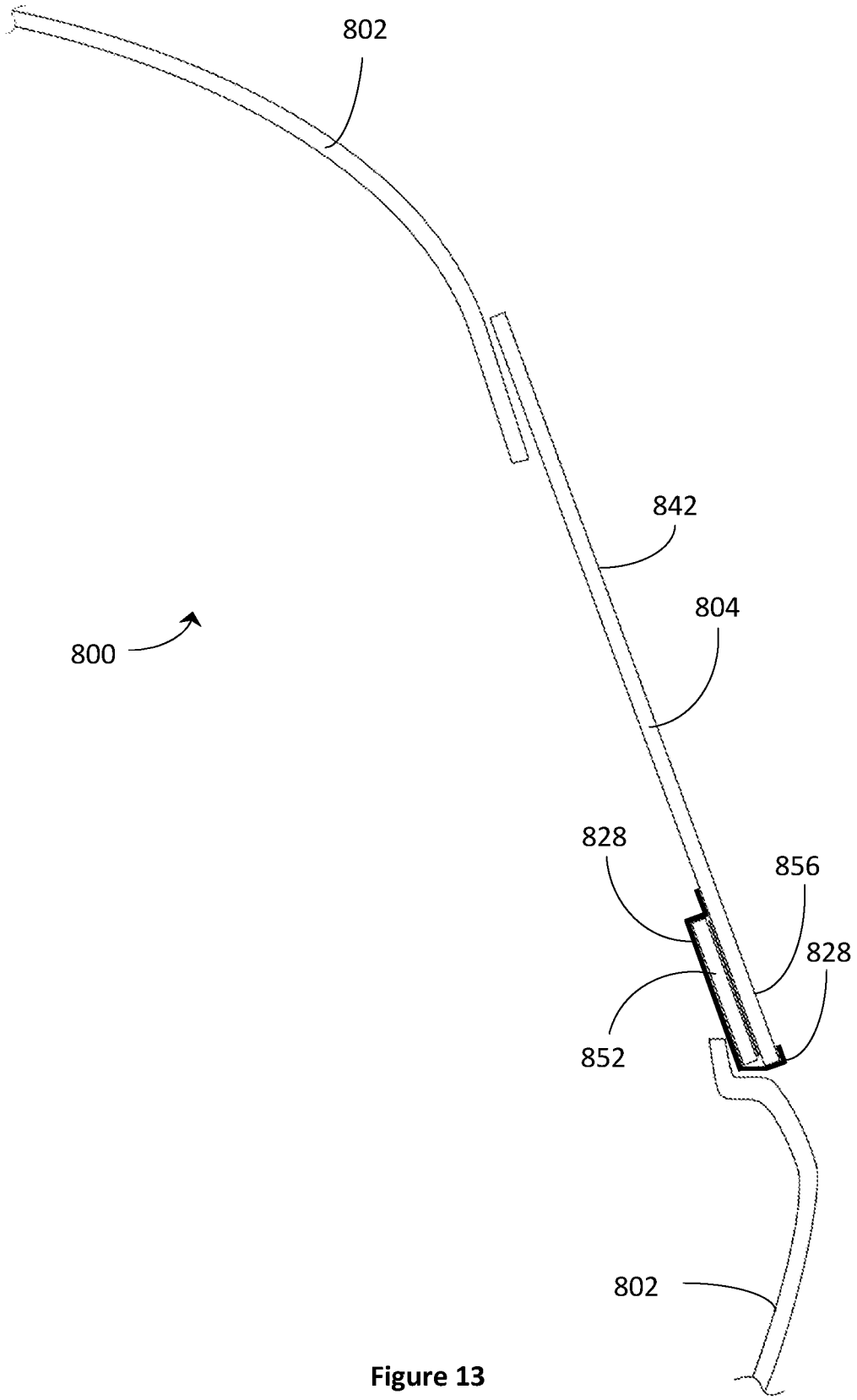
FIG. 13 shows a partial cross section of a crash helmet including a display module installed on a visor, in accordance with an embodiment of the present invention.

A further variation of the helmet attachment is shown in FIG. 13. FIG. 13 shows a partial cross section of a crash helmet 800 including an outer shell 802 of protective material (such as fibreglass, carbon fibre, Kevlar or polycarbonate), and a visor 804. The visor 1804 may optionally include an anti-fog layer (not shown) as known in the art. The helmet 800 also includes interior shock absorbing material (such as expanded polystyrene) as known in the art (not shown for clarity). The visor 804 comprises a display module 852 positioned beneath an inside portion 856 of the optically clear visor 804, proximate to a bottom of the visor. Preferably the full extent of the visor 804 is optically clear. The display module 852 is preferably as described above in relation to any of FIGS. 2A to 11F, and includes a flexible electronic display screen (preferably a reflective display screen) visible through the optically clear portion 856 of the visor 804. The display module 852 is preferably curved so as to conform to the inside surface of the optically clear portion 856 of the visor 804, advantageously requiring little, if any modification of the outer shell 802 to accommodate the display module 852 when the visor 804 is closed. Advantageously, the visor 804 itself provides protection for the display module 852 without the need for additionally protective optically clear plastic layers. Optionally, the display module is fixed to the visor 804 by means of vinyl wrap material 828.

Figure 14A:
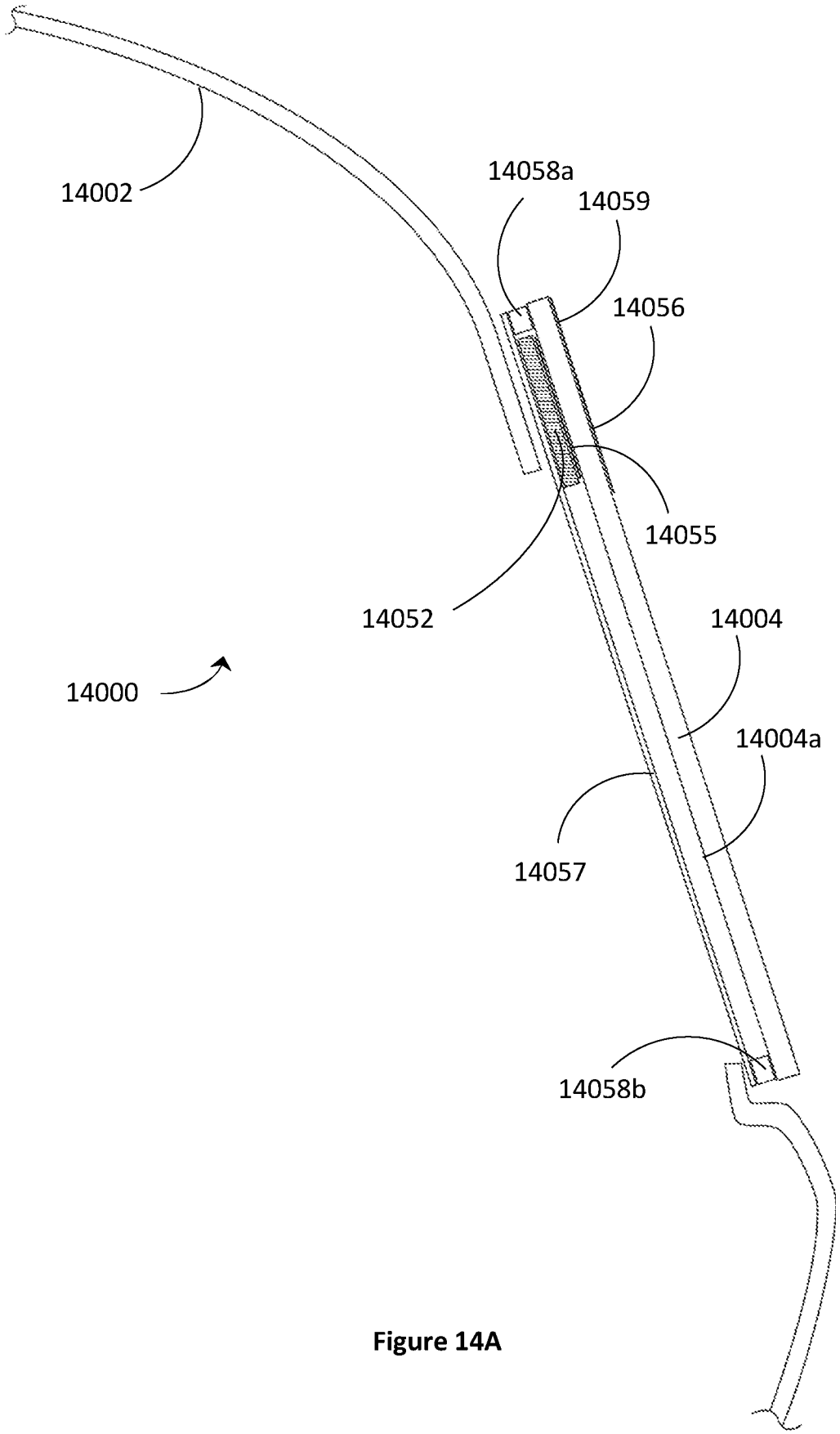
FIG. 14A shows a partial cross section of a crash helmet including a display module installed on a visor, in accordance with an embodiment of the present invention.
Figure 14B:
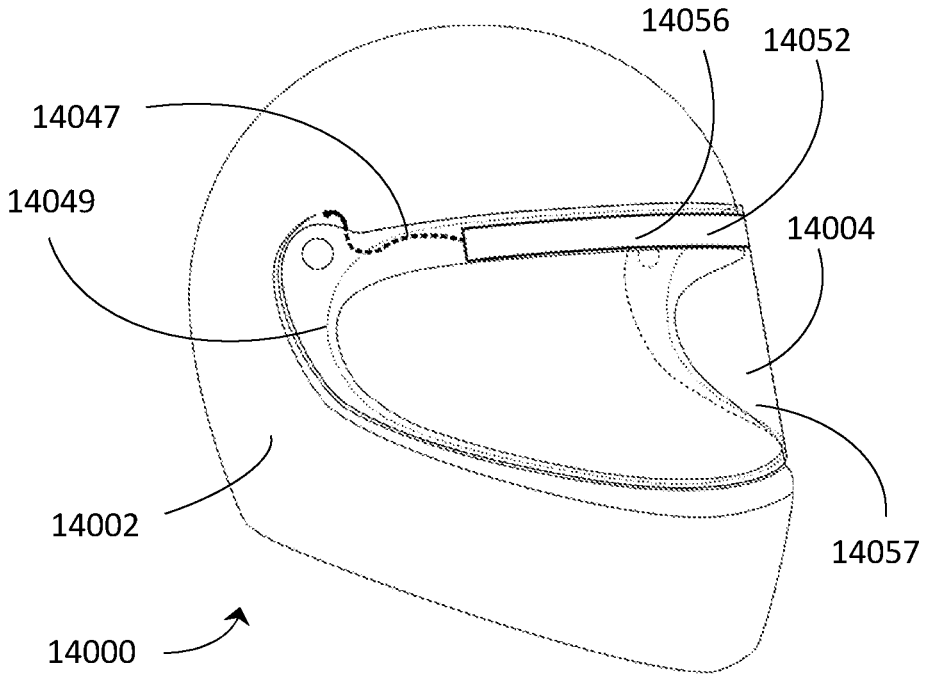
FIGS. 14B and 14C show perspective views of the crash helmet of FIG. 14A.
Figure 14C:
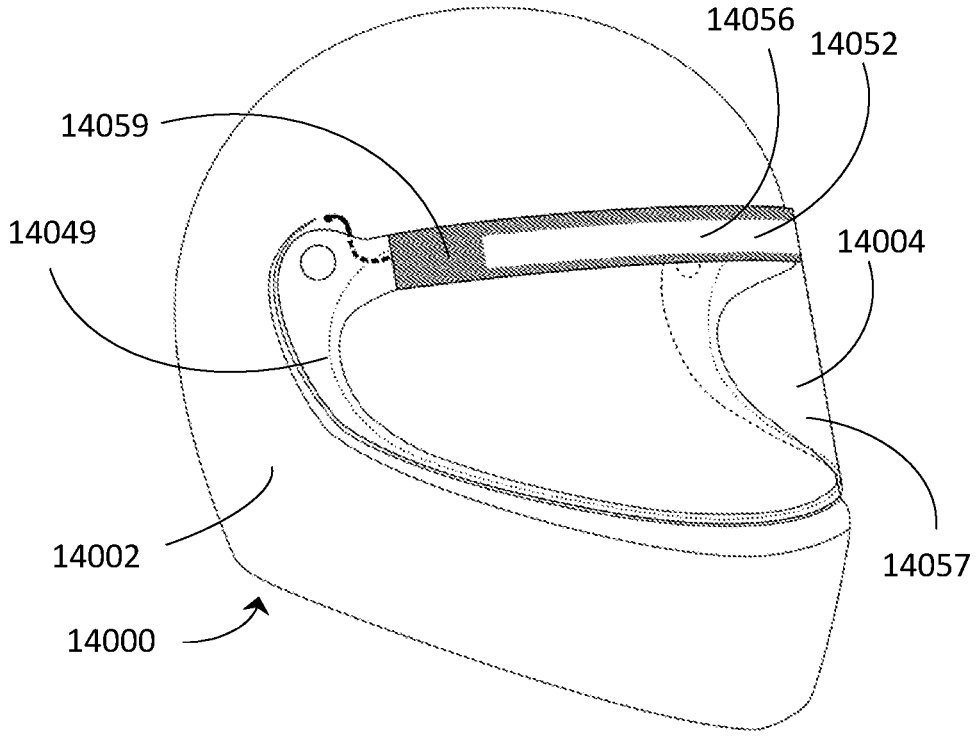

A further embodiment of an attachment for a crash helmet is shown in FIGS. 14A to 14C. FIG. 14A shows a partial cross section of a crash helmet 14000 including an outer shell 14002 as described above in relation to the helmets 700, 800 of the embodiments of FIGS. 12 and 13. The helmet 14000 includes a visor 14004, which includes an anti-fog layer 14057 as known in the art. The anti-fog layer 14057 is sealed against the inner surface 14004*a* of the visor 14004 by means of one or more seals 14058*a*, 14058*b* (e.g., a silicone sealing strip following a perimeter of the anti-fog layer).

A display module 14052 comprising a flexible display screen is positioned between the anti-fog layer 14057 and the inside surface 14004*a*, with the viewing face of the display screen visible through the visor 14004. Preferably the display module 14052 is secured to the inside surface 14004*a* by an optically clear adhesive. Though shown positioned proximate to a top of the visor 14004, the display module 14052 could be positioned at another position between the inside surface 14004*a* and the anti-fog layer 14057 that does not impair the user's visibility through the visor 14004, for example proximate to the bottom of the visor 14004.

Optionally a vinyl wrap materials 14059 is provided on the visor shaped to as to obscure at least some parts of the display module 14052, for example parts of the display module 14052 other than a viewable area of the display screen.

Optionally, a cable 14047 can extend through an aperture in the one or more seals 14058*a*, 14058*b*, to connect the display module 14052 to a remote power source and/or display controller (such as the display controllers 218*a*, 128*b* described above in relation to the embodiment of FIGS. 2A-2D).

Beneficially, this arrangement makes use of a pre-existing space in the visor 14004 to house the display module 14052. Again, the visor 14004 itself also acts as a protective covering for the display module 14052.

FIGS. 14B and 14C show perspective views of the helmet 14000. FIG. 14A shows the visor 14004 without the optional vinyl wrap material; FIG. 14B shows the visor 14004 with the optional vinyl wrap material. The perimeter 14049 of the anti-fog layer 14057 is also shown.

Figure 15:
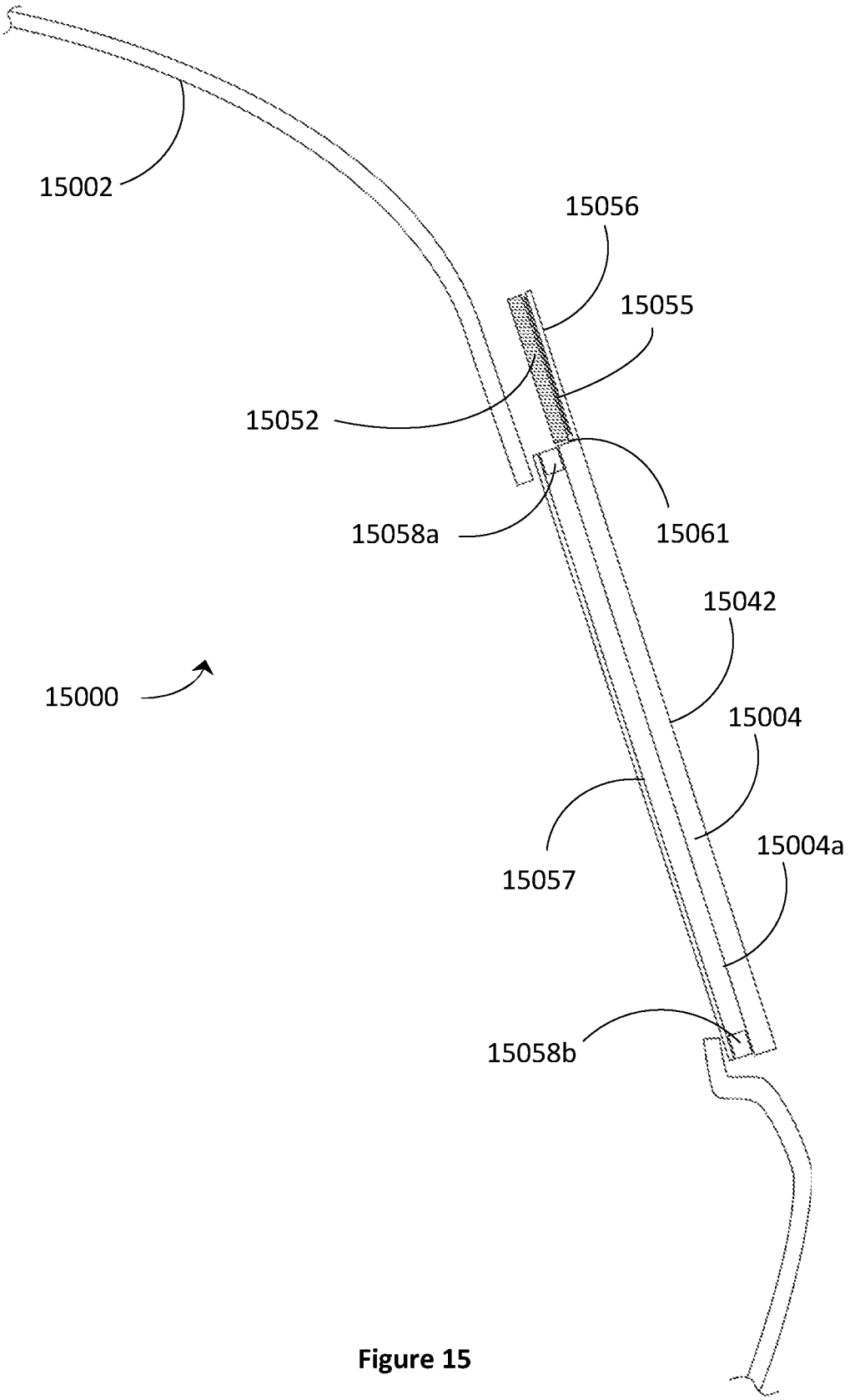
FIG. 15 shows a partial cross section of a crash helmet including a display module installed on a visor, in accordance with an embodiment of the present invention.

A further embodiment of an attachment for a crash helmet is shown in FIG. 15, which shows a partial cross section of a crash helmet 15000 including an outer shell 15002 as described above in relation to the helmets 700, 800 of the embodiments of FIGS. 12 and 13. The helmet 15000 includes a visor 15004, which includes an anti-fog layer 15057 and corresponding seals 15058*a*, 15058*b* as described above in relation to FIGS. 14A to 14C.

In this embodiment, a display module 15052 comprising a flexible display screen is positioned in a recess 15061 in the inner surface 15004*a* of the visor 15004, beneath an optically clear portion 15056 of the visor 15004 at a position failing outside the perimeter of the anti-fog later 15057. Optionally, the recess 15061 is a rebate formed at an outer edge of the inner surface 15004*a* (e.g., a top edge, as shown in FIG. 15)—alternatively the recess may be a distance away from the outer edge of the inner surface 15004*a*. The display module 15052 is preferably secured to the recess 15061 using an optically clear adhesive 15055.

Optionally, the height of the visor 15004 may be extended (e.g., at a top or bottom edge) as compared to the visor 14004 of FIGS. 14A to 14C, thereby providing space to house a display module 15052 with a flexible display screen having greater area, while advantageously obscuring very little/none of the user's field of view.

Again, the outer surface 15042 of the visor 15004 provides protection to the display module 15052.

Optionally a vinyl wrap materials (not shown) is provided on the outer surface 15042 (and optionally also on the inside surface 15004*a*) of the visor 15004, shaped to as to obscure at least some parts of the display module 15052, for example parts of the display module 15052 other than a viewable area of the display screen.

Figure 16A:
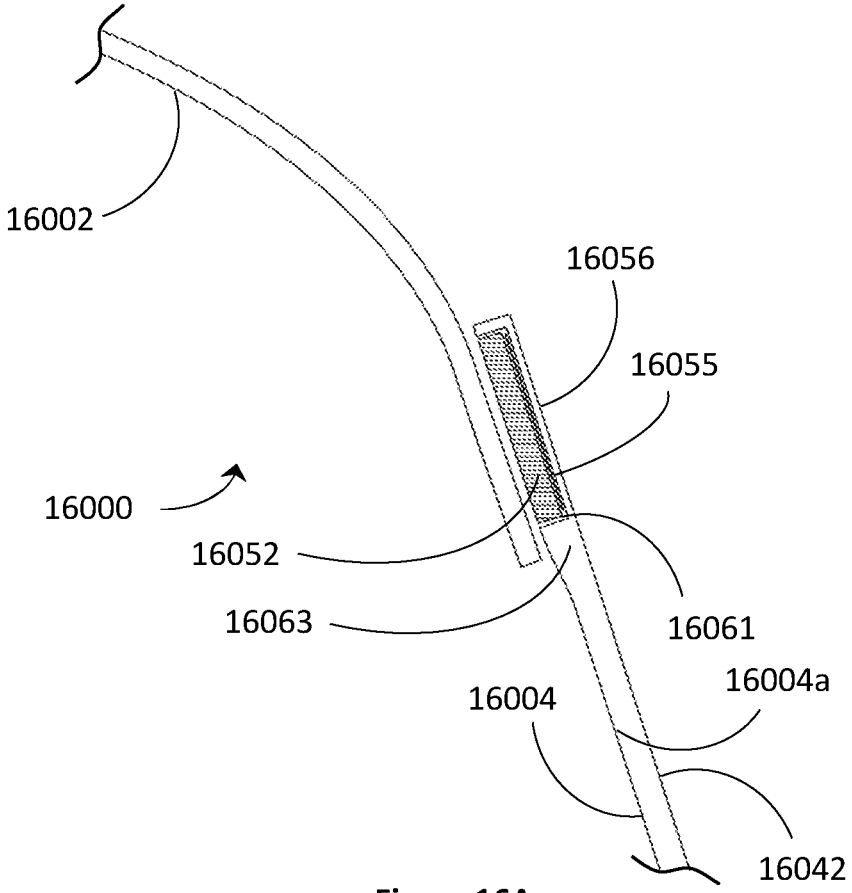
FIG. 16A shows a partial cross section of a crash helmet including a display module installed on a visor, in accordance with an embodiment of the present invention.
Figure 16B:
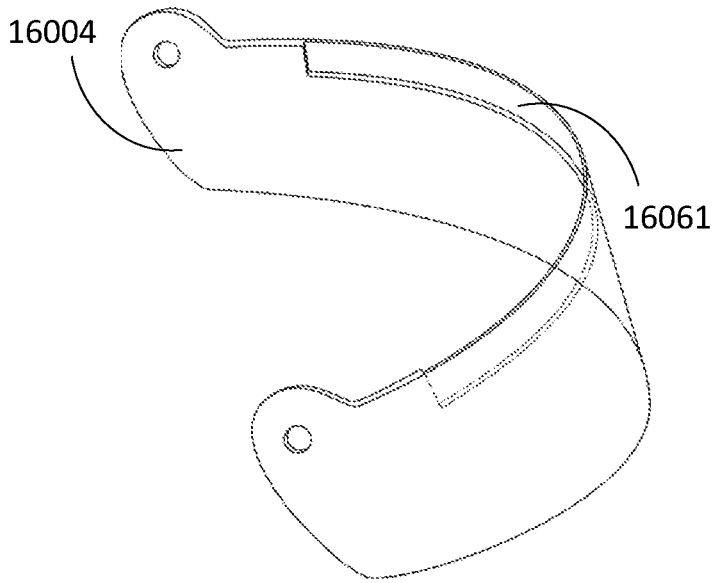
FIG. 16B shows a perspective view of a visor suitable for use with the crash helmet of FIG. 16A.

A further embodiment of an attachment for a crash helmet is shown in FIGS. 16A and 16B. FIG. 16A shows a partial cross section of a crash helmet 16000 including an outer shell 16002 as described above in relation to the helmets 700, 800 of the embodiments of FIGS. 12 and 13. The helmet 16000 includes a visor 16004. The visor 16004 may optionally include an anti-fog layer (not shown) as known in the art. A perspective view of the visor 16004 in isolation is provided in FIG. 16B.

In this embodiment, a display module 16052 comprising a flexible display screen is positioned in a recess 16061 in the inner surface 16004*a* of the visor 16004, beneath an optically clear portion 16056 of the visor 16004. Optionally, the recess may be a distance away from the outer edge of the inner surface 16004*a* (e.g., close to a top edge, as shown in FIGS. 16A and 16B)—alternatively, the recess 16061 is a rebate formed at an outer edge of the inner surface 16004*a*. The display module 16052 is preferably secured to the recess 16061 using an optically clear adhesive 16055.

Though shown proximate to the top of the visor 16004, the display module 16052 could also be located at other positions which do not unduly limit the user's field of view, such as proximate to the bottom of the visor 16004.

Optionally, the height of the visor 16004 may be extended (e.g., at a top or bottom edge) so as to overlap the outer shell 16002 when the visor 16004 is in a closed position, thereby providing space to house a display module 16052 with a flexible display screen having greater area, while advantageously obscuring very little/none of the user's field of view.

The visor 16004 optionally includes a thickened portion 16063. Beneficially, acts to smooth the visual disparity in caused by a difference in thickness between the combination of the display module 16052 and the portion of the visor 16004 lying above the recess 16061, and the rest of the visor 16004 (in the event that the display module 16052 would otherwise be deeper than the depth of the recess 16061).

The outer surface 16042 of the visor 16004 provides protection to the display module 16052.

Optionally a vinyl wrap materials (not shown) is provided on the outer surface 166042 (and optionally also on the inside surface) of the visor 16004, shaped to as to obscure at least some parts of the display module 16052, for example parts of the display module 16052 other than a viewable area of the display screen.

In general, the embodiments described in relation to FIGS. 12 to 16B provide for easy access to the display module 752, 852, 14052, 15052, 16052 by simply removing the visor 704, 804, 14004, 15004, 16004 from the helmet 700, 800, 14000, 15000, 16000, facilitating easy maintenance and replacement.

Figure 17A:
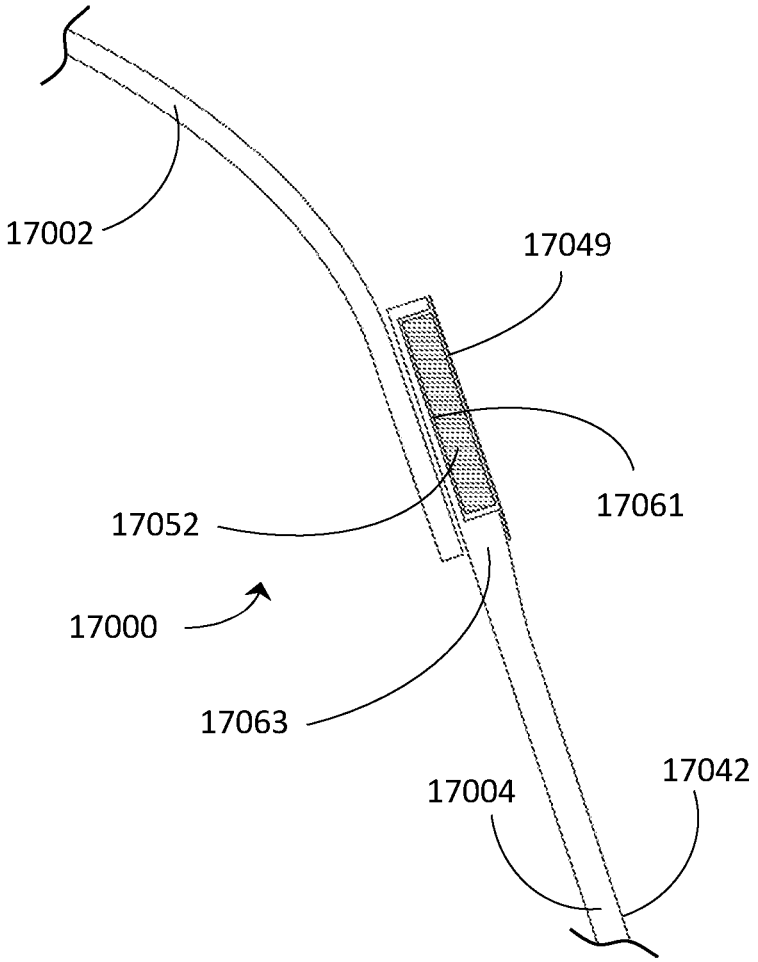
FIG. 17A shows a partial cross section of a crash helmet including a display module installed on a visor, in accordance with an embodiment of the present invention.
Figure 17B:
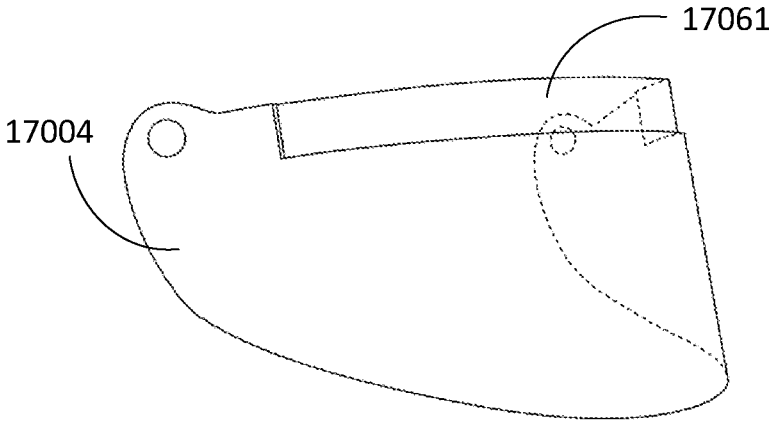
FIG. 17B shows a perspective view of a visor suitable for use with the crash helmet of FIG. 17A.

A further embodiment of an attachment for a crash helmet is shown in FIGS. 17A and 17B. FIG. 17A shows a partial cross section of a crash helmet 17000 including an outer shell 17002 as described above in relation to the helmets 700, 800 of the embodiments of FIGS. 12 and 13. The helmet 17000 includes a visor 17004. The visor 17004 may optionally include an anti-fog layer (not shown) as known in the art. A perspective view of the visor 17004 in isolation is provided in FIG. 17B.

In this embodiment, a display module 17052 comprising a flexible display screen is positioned in a recess 17061 in the outer surface 17042 of the visor 17004. Optionally, the recess may be a distance away from the outer edge of the outer surface 17042 (e.g., close to a top edge, as shown in FIGS. 17A and 17B)—alternatively, the recess 17061 is a rebate formed at an outer edge of the outer surface 17042. The display module 17052 is preferably secured to the recess 17061 by means of a protective, at least partially optically clear layer of vinyl wrap 17059. Optionally the vinyl wrap materials comprises non-optically clear portions, shaped to as to obscure at least some parts of the display module 17052, for example parts of the display module 17052 other than a viewable area of the display screen. Optionally the vinyl wrap 17059 extends onto an inside surface of the visor.

Advantageously, this arrangement provides for even easier access to the display module 17052 facilitating easy maintenance and replacement, without the need to remove the visor from the helmet Though shown proximate to the top of the visor 17004, the display module 17052 could also be located at other positions which do not unduly limit the user's field of view, such as proximate to the bottom of the visor 17004.

Optionally, the height of the visor 17004 may be extended (e.g., at a top or bottom edge) so as to overlap the outer shell 17002 when the visor 17004 is in a closed position, thereby providing space to house a display module 17052 with a flexible display screen having greater area, while advantageously obscuring very little/none of the user's field of view.

The visor 17004 optionally includes a thickened portion 17063. Beneficially, acts to smooth the visual disparity in caused by a difference in thickness between the combination of the display module 17052 and the portion of the visor 17004 lying below the recess 17061, and the rest of the visor 17004 (in the event that the display module 16052 would otherwise be deeper than the depth of the recess 16061).

Preferably, the helmets 700, 800, 14000, 15000, 16000, 17000 of FIGS. 12 to 17B also include a proximity sensor and/or an environmental sensor in communication with a display controller, with functionality corresponding to the analogous sensors 230, 232 described above in relation to FIGS. 2A to 2D.

Although shown as having a substantially rectangular viewable area in FIGS. 11A to 17A, the display module 652, 752, 852, 14052, 15052, 16052, 17052 may be any shape. Advantageously, in the context of the embodiments of FIGS. 12 to 17B, the display module 752, 852, 14052, 15052, 16052, 17052 is preferably shaped so as to follow the profile of a portion of the edge of the visor 704, 804, 14004, 15004, 16004, 17004, increasing the viewable area of the display module 752, 852, 14052, 15052, 16052, 17052. Similarly, the display module 612 of the embodiment of FIGS. 11A to 11C may also be shaped so as to follow a profile of the attachment 640*a*, 640*b*, 641.

In general, the variations described above in relation to FIGS. 11A to 17 provide advantages in terms of ease of installation and access for repair, modification etc. In particular, by including a display on an attachment such as a ventilation attachment, aerodynamic attachment or visor, access to the display can be gained by simply removing the attachment from the helmet. Further, attachments incorporating a display as described above banefully allow for easy manufacture and retrofitting to existing helmets.

Figure 18:
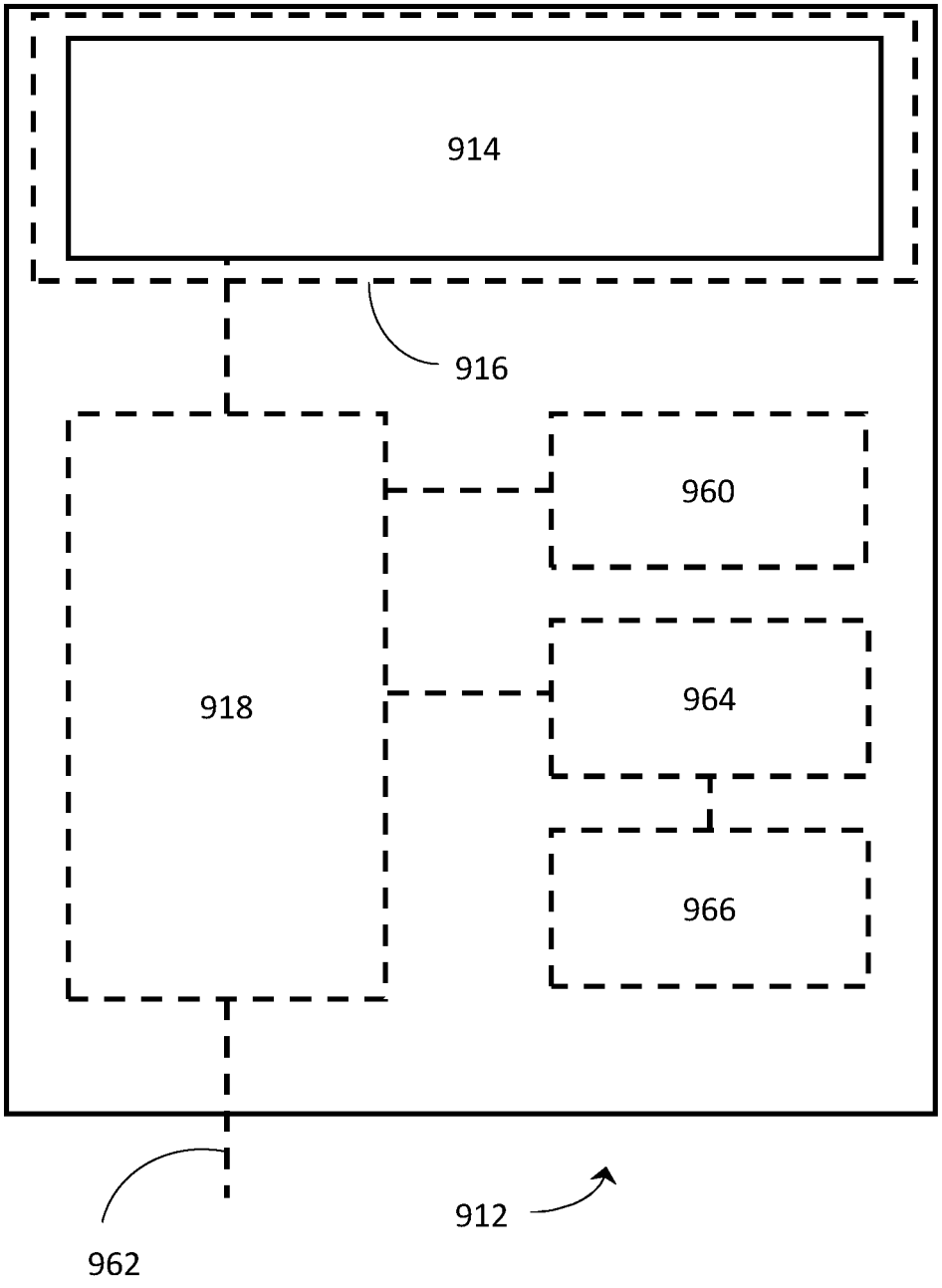
FIG. 18 shows a schematic representation of a display module in accordance with embodiments of the present invention.

FIG. 18 shows a schematic representation of a display module 912 suitable for use as the display modules 212, 3012, 4012, 5012, 6012, 7012, 312, 412, 652, 752, 852, 14052, 15052, 16052, 17052 described above. The display module 912 includes a flexible electronic display screen 914 (preferably a reflective display) such as the display screens 214, 3014, 4014, 5014, 6014, 7014, 314, 414, 614 described above, and optionally a display controller 918 such as the display controllers 218*a*, 218*b*, 618*a*, 618*b* described above.

Optionally the display module 912 includes a wireless communication module 960 (e.g., configured to communicate via Wi-Fi, Bluetooth or NFC protocols). Alternatively, or in addition, the display module 912 includes a wired data and/or power connection 962. The display controller is preferably configured to communication with proximity and/or environmental sensors via the wired connection 962 and/or wireless communication module 960. Beneficially, the wired connection 962 may link directly to a pre-existing communications cable present in the helmet for other purposes.

Optionally the display module 912 is configured to receive data from an external server, the data containing instructions for displaying content on the flexible electronic display 914. For example, images and other content may be received from the server for display on the flexible electronic display screen 914. For example, the server may provide content in real time for display on the flexible electronic display screen 914, such as advertising content and/or race information (for example a current race position or lap number of the wearer's vehicle).

Optionally the display module 912 includes a power source, including a battery 964 and optionally an inductive wireless charging module 966 to enable wireless charging of the battery 964.

The display module 912 optionally includes a protective layer of plastics material 916 (such as the layers 216, 3016, 4016, 5016, 3017, 4017, 5017, 6017, 656 described above), configured to cover at least the flexible electronic display screen 914.

The above embodiments are provided as examples only. It is noted that the various embodiments above may also be combined. For example, a helmet may include one of more of the recessed displays shown in FIGS. 2A to 6C, recessed displays situated under a visor in use as shown in FIGS. 8A to 9C, and displays on one or more attachments as shown in FIGS. 11A to 17. Similarly, more than one display of any of the types described above may be provided on a single helmet. It is further noted that the precise shape and position of any of the display modules, flexible electronic displays and optically clear protective layers will depend on factors such as the type, shape and location of helmet/helmet attachment on which the display is being provided.

Further aspects of the invention will be understood from the appended claims.

The invention claimed is:

1. A protective helmet adapted for the external display of controllably selectable images, comprising:

an outer portion;

a display module comprising a flexible electronic display screen; and an at least partially optically clear plastics layer coupled to the flexible electronic display screen by an optically clear adhesive layer;

wherein the outer portion comprises a recess configured to receive the display module; and wherein the display module is positioned within the recess such that an outer surface of the display module continues a profile of an outer surface of the outer portion.

2. The protective helmet of claim 1, wherein the flexible display is a reflective display.

3. The protective helmet of claim 1, further comprising a visor configured to move between an open position and a closed position;

wherein the visor covers the outer surface of the display module when in the closed position, such that content displayed on the flexible electronic display screen is visible through the visor.

4. The protective helmet of claim 1, wherein:

the outer surface of the at least partially optically clear layer is curved in a first plane; and the outer surface of the at least partially optically clear layer is curved in a second plane, the second plane orthogonal to the first plane.

5. The protective helmet of claim 1, wherein the at least partially optically clear layer includes one or more voids.

6. The protective helmet claim 1 wherein:

the outer portion comprises a portion adjacent to the recess;

the recess comprises a floor and a wall extending between the floor and the portion adjacent to the recess;

the wall lies at an obtuse angle with respect to each of the floor and the portion adjacent to the recess.

7. The protective helmet of claim 1, wherein:

the protective helmet comprises a display controller communicably coupled to the display module; or the display module comprises a display controller; or the display module comprises a wired or wireless connection to a display controller;

wherein the protective helmet further comprises a proximity sensor:

wherein the proximity sensor is configured to detect when the protective helmet is being worn, and to provide a signal indicative that the protective helmet is being worn to the display controller; and wherein the display controller is configured to activate the flexible electronic display responsive to receiving the signal from the proximity sensor.

8. The protective helmet of claim 1, wherein:

the protective helmet comprises a display controller communicably coupled to the display module; or the display module comprises a display controller; or the display module comprises a wired or wireless connection to a display controller; wherein the protective helmet further comprises an environmental sensor, configured to detect a physical state of the protective helmet and to provide a signal indicative of the physical state of the helmet to the display controller;

wherein the display controller is configured to control the flexible electronic display responsive to receiving the signal from the environmental sensor.

9. The protective helmet of claim 8, wherein:

the environmental sensor is a shock sensor;

the display controller is connected to a biometric sensor configured to measure biometric information of the wearer of the protective helmet; and the display controller is configured to cause the flexible electronic display screen to display biometric information in response to the shock sensor detecting a shock greater than a predetermined amount.

10. The protective helmet of claim 1, further comprising a protective helmet attachment, wherein the attachment comprises the outer portion, wherein the attachment is one of: a visor, a ventilation attachment, an aerodynamic attachment.

11. The protective helmet of claim 1, further comprising a protective helmet attachment, wherein the attachment comprises the outer portion, wherein the attachment comprises an at least partially optically clear housing, and wherein the outer surface of the display module is an outer surface of the at least partially optically clear housing.

12. A protective helmet attachment adapted for the external display of controllably selectable images, comprising:

an outer surface; and a display module, the display module comprising:

a flexible electronic display screen;

an optically clear portion coupled to the flexible electronic display screen by an optically clear adhesive layer;

wherein the display module is shaped and positioned so as to conform to a profile of the outer surface.

13. The protective helmet attachment of claim 12 wherein:

the flexible electronic display is positioned beneath the optically clear portion such that the flexible electronic display is visible through the optically clear portion; and the optically clear portion continues the profile of the outer surface.

14. The protective helmet attachment of claim 13, further comprising a recess configured to receive the display module, wherein the display module is positioned within the recess such that the display module continues the profile of the outer surface, wherein:

the optically clear portion comprises one or more voids.

15. The protective helmet attachment of claim 12 further comprising a recess configured to receive the display module, wherein the display module is positioned within the recess such that the display module continues the profile of the outer surface.

16. The protective helmet attachment of claim 12, wherein the protective helmet attachment is one of: a visor, a ventilation attachment, an aerodynamic attachment.

17. The protective helmet attachment of claim 12, wherein:

the protective helmet attachment is a visor; the visor comprises an anti-fog layer;

the display module is positioned between an inner surface of the visor and the anti-fog layer.

18. The protective helmet attachment of claim 12, wherein:

the protective helmet attachment is a visor;

the visor comprises a recess;

the flexible electronic display is positioned in the recess.

19. The protective helmet attachment of claim 12, wherein:

the display module comprises an at least partially optically clear housing;

the at least partially optically clear housing comprises the optically clear portion; and the at least partially optically clear housing comprises a recess configured to receive the flexible electronic display, such that the flexible electronic display screen is visible through the optically clear portion of the at least partially optically clear housing.

20. The protective helmet attachment of claim 12, wherein the flexible display is a reflective display.

21. The protective helmet attachment of claim 12 wherein:

the attachment comprises a display controller communicably coupled to the display module;

the display module comprises a display controller; or the display module comprises a wired or wireless connection to a display controller;

the protective helmet attachment further comprising an environmental sensor, configured to detect a physical state of the protective helmet and to provide a signal indicative of the physical state of the helmet to the display controller;

wherein the display controller is configured to control the flexible electronic display responsive to receiving the signal from the environmental sensor.

22. The protective helmet attachment of claim 21, wherein:

the environmental sensor is a shock sensor;

the display controller is connected to a biometric sensor configured to measure biometric information of the wearer of the protective helmet; and the display controller is configured to cause the flexible electronic display screen to display biometric information in response to the shock sensor detecting a shock greater than a predetermined amount.

23. The protective helmet attachment of claim 12, wherein the protective helmet attachment is configured to cover a helmet aperture in use.

24. The protective helmet attachment of claim 12, wherein the flexible electronic display screen is curved so as to conform to an inside surface of the optically clear portion.

25. A protective helmet comprising a protective helmet attachment adapted for the external display of controllably selectable images, the protective helmet attachment comprising:

an outer surface;

a display module comprising a flexible electronic display screen; and an optically clear portion coupled to the flexible electronic display screen by an optically clear adhesive layer;

wherein the display module is shaped and positioned so as to conform to a profile of the outer surface.

26. The protective helmet of claim 25, wherein:

the attachment comprises a display controller communicably coupled to the display module;

the display module comprises a display controller; or the display module comprises a wired or wireless connection to a display controller;

and wherein the protective helmet further comprises a proximity sensor:

wherein the proximity sensor is configured to detect when the protective helmet is being worn, and to provide a signal indicative that the protective helmet is being worn to the display controller; and wherein the display controller is configured to activate the flexible electronic display responsive to receiving the signal from the proximity sensor.

27. The protective helmet of claim 25, wherein:

the attachment comprises a display controller communicably coupled to the display module;

the display module comprises a display controller; or the display module comprises a wired or wireless connection to a display controller;

and wherein the protective helmet further comprises an environmental sensor, configured to detect a physical state of the protective helmet and to provide a signal indicative of the physical state of the helmet to the display controller;

wherein the display controller is configured to control the flexible electronic display responsive to receiving the signal from the environmental sensor.

28. The protective helmet of claim 27, wherein:

the environmental sensor is a shock sensor;

the display controller is connected to a biometric sensor configured to measure biometric information of the wearer of the protective helmet; and the display controller is configured to cause the flexible electronic display screen to display biometric information in response to the shock sensor detecting a shock greater than a predetermined amount.

* * * * *